US010659901B2

(12) United States Patent
Hofmann et al.

(10) Patent No.: US 10,659,901 B2
(45) Date of Patent: May 19, 2020

(54) RENDERING SYSTEM

(71) Applicant: Fraunhofer-Gesellschaft zur Förderung der angewandten Forschung e. V., München (DE)

(72) Inventors: Christian Hofmann, Erlangen (DE); Walter Kellermann, Eckental (DE)

(73) Assignee: Fraunhofer-Gesellschaft zur Förderung der angewandten Forschung e.V. (DE)

( * ) Notice: Subject to any disclaimer, the term of this patent is extended or adjusted under 35 U.S.C. 154(b) by 0 days.

(21) Appl. No.: 15/920,914

(22) Filed: Mar. 14, 2018

(65) Prior Publication Data

US 2018/0206052 A1 Jul. 19, 2018

Related U.S. Application Data

(63) Continuation of application No. PCT/EP2016/069074, filed on Aug. 10, 2016.

(30) Foreign Application Priority Data

Sep. 25, 2015 (DE) ..... 10 2015 218 527

(51) Int. Cl.
*H04S 7/00* (2006.01)
*H04R 5/02* (2006.01)

(52) U.S. Cl.
CPC ..... *H04S 7/301* (2013.01); *H04R 5/02* (2013.01); *H04S 2400/09* (2013.01);
(Continued)

(58) Field of Classification Search
None
See application file for complete search history.

(56) References Cited

U.S. PATENT DOCUMENTS 5,555,310 A 9/1996 Minami et al.
5,949,894 A * 9/1999 Nelson ..... H04S 1/002 381/17

(Continued)

FOREIGN PATENT DOCUMENTS

CN 102918870 A 2/2013
DE 102013218176 A1 3/2015

(Continued)

OTHER PUBLICATIONS

H. Buchner, J. Benesty, and W. Kellermann, "Generalized multichannel frequencydomain adaptive filtering: Efficient realization and application to hands-free speech communication," Signal Processing, vol. 85, No. 3, pp. 549-570, Mar. 2005 (22 pages).

(Continued)

*Primary Examiner* — Qin Zhu
(74) *Attorney, Agent, or Firm* — Haynes and Boone, LLP

(57) ABSTRACT

A rendering system including a plurality of loudspeakers, at least one microphone and a signal processing unit. The signal processing unit is configured to determine at least some components of a loudspeaker-enclosure-microphone transfer function matrix estimate describing acoustic paths between the plurality of loudspeakers and the at least one microphone using a rendering filters transfer function matrix using which a number of virtual sources is reproduced with the plurality of loudspeakers.

14 Claims, 13 Drawing Sheets

(52) U.S. Cl.
CPC ..... *H04S 2400/11* (2013.01); *H04S 2400/15* (2013.01); *H04S 2420/01* (2013.01); *H04S 2420/11* (2013.01); *H04S 2420/13* (2013.01)

(56) References Cited

U.S. PATENT DOCUMENTS

| | | | | |
|---|---|---|---|---|
| 6,574,339 | B1 * | 6/2003 | Kim | H04S 3/00 381/17 |
| 6,760,447 | B1 * | 7/2004 | Nelson | H04R 5/02 381/17 |
| 8,407,059 | B2 * | 3/2013 | Cho | G10L 19/008 370/487 |
| 2004/0223620 | A1 * | 11/2004 | Horbach | H04R 29/002 381/59 |
| 2005/0008170 | A1 * | 1/2005 | Pfaffinger | H04S 7/30 381/96 |
| 2010/0098274 | A1 * | 4/2010 | Hannemann | H04R 1/403 381/300 |
| 2014/0358567 | A1 * | 12/2014 | Koppens | G10L 19/008 704/500 |
| 2015/0189435 | A1 | 7/2015 | Sako et al. | |
| 2015/0237428 | A1 | 8/2015 | Schneider et al. | |
| 2016/0071508 | A1 * | 3/2016 | Wurm | G10K 11/1784 381/58 |
| 2016/0198280 | A1 | 7/2016 | Schneider et al. | |

FOREIGN PATENT DOCUMENTS

| | | | |
|---|---|---|---|
| EP | 1475996 | B1 | 4/2009 |
| JP | S61 212996 | A | 9/1986 |
| JP | 2011 193195 | A | 9/2011 |
| JP | 2014 093697 | A | 5/2014 |
| JP | 2016 534667 | A | 11/2016 |
| WO | WO 9954867 | A1 | 10/1999 |
| WO | WO 2014015914 | A1 | 1/2014 |
| WO | WO 2015062864 | A1 | 5/2015 |

OTHER PUBLICATIONS

J. Benesty, D. Morgan, and M. Sondhi, "A better understanding and an improved solution to the specific problems of stereophonic acoustic echo cancellation," IEEE Transactions on Speech and Audio Processing, vol. 6, No. 2, pp. 156-165, 1998 (10 pages).

G. H. Golub and C. F. Van Loan, Matrix Computations, 3rd ed. Johns Hopkins University Press, 1996 (367 pages).

K. Helwani and H. Buchner, "On the eigenspace estimation for supervised multichannel system identification," in IEEE International Conference on Acoustics, Speech, and Signal Processing (ICASSP), May 2013, pp. 630-634 (5 pages).

J. Herre, H. Buchner, and W. Kellermann, "Acoustic echo cancellation for surround sound using perceptually motivated convergence enhancement," in IEEE International Conference on Acoustics, Speech, and Signal Processing (ICASSP), Honolulu, HI, USA, Apr. 2007 (4 pages).

K. Helwani, H. Buchner, and S. Spors, "Source-domain adaptive filtering for MIMO systems with application to acoustic echo cancellation," in IEEE International Conference on Acoustics, Speech, and Signal Processing (ICASSP), 2010, pp. 321-324 (4 pages).

D. Morgan, J. Hall, and J. Benesty, "Investigation of several types of nonlinearities for use in stereo acoustic echo cancellation," IEEE Transactions on Speech and Audio Processing, vol. 9, No. 6, pp. 686-696, Sep. 2001 (11 pages).

S. Spors, H. Buchner, and R. Rabenstein, "Eigenspace adaptive filtering for efficient pre-equalization of acoustic MIMO systems," in Proceedings of the European Signal Processing Conference (EUSIPCO), vol. 6, 2006 (5 pages).

M. Schneider, C. Huemmer, and W. Kellermann, "Wave-domain loudspeaker signal decorrelation for system identification in multichannel audio reproduction scenarios," in IEEE International Conference on Acoustics, Speech, and Signal Processing (ICASSP), May 2013, pp. 605-609 (5 pages).

J. Mamou et al.: "System combination and score normalization for spoken term detection", 2013 IEEE International Conference on Acoustics, Speech and Signal Processing (ICASSP); Vancouver, BC; May 26-31, 2013, Institute of Electrical and Electronics Engineers, Piscataway, NJ, US, doi:10.1109/ICASSP.2013.6639278, ISSN 1520-6149, (May 26, 2013), pp. 8272-8276, (Oct. 18, 2013), XP032508928 (5 pages).

S. Spors, R. Rabenstein, and J. Ahrens, "The theory of wave field synthesis revisited," in Audio Engineering Society Convention 124, 2008 (19 pages).

G. Strang, Introduction to Linear Algebra, 4th ed. Wellesley—Cambridge, 2009 (According to the inventors, this reference is a standard work in Algebra, available in university libraries as a printed book. A free pdf-version can be downloaded here: https://github.com/liuchengxu/books/blob/master/docs/src/Theory/Introduction-to-Linear-Algebra-4th-Edition.PDF).

Notice of Allowance dated May 28, 2019 issued in the parallel Japanese patent application No. 2018-515782 (6 pages).

Office Action dated Dec. 25, 2019 issued in the parallel Chinese patent application No. 201680055983.6 (32 pages).

* cited by examiner

RENDERING SYSTEM

CROSS-REFERENCE TO RELATED APPLICATIONS

This application is a continuation of co-pending International Application No. PCT/EP2016/069074, filed Aug. 10, 2016, which is incorporated herein by reference in its entirety, and additionally claims priority from German Application No. DE 102015218527.3, filed Sep. 25, 2015, which is incorporated herein by reference in its entirety.

Embodiments relate to a rendering system and a method for operating the same. Some embodiments relate to a source-specific system identification.

BACKGROUND OF THE INVENTION

Applications, such as Acoustic Echo Cancellation (AEC) or Listening Room Equalization (LRE) involve the identification of acoustic Multiple-Input/Multiple-Output (MIMO) systems. In practice, multichannel acoustic system identification suffers from the strongly cross-correlated loudspeaker signals typically occurring when rendering virtual acoustic scenes with more than one loudspeaker: the computational complexity grows with at least the number of acoustical paths through the MIMO system, which is $N_L \cdot N_M$ for $N_L$ loudspeakers and $N_M$ microphones. Robust fast-converging algorithms for multichannel filter adaptation, such as the Generalized Frequency Domain Adaptive Filtering [GFDAF] [BBK05] even have a complexity of $N_L^3$ when robustly solving the involved linear systems of equations for cross-correlated loudspeaker signals by a Cholesky decomposition [GVL96]. Even more, if the number of loudspeakers is larger than the number of virtual sources $N_S$ (i.e. the number of spatially separated sources with independent signals), the acoustic paths from the loudspeakers to the microphones of the LEMS cannot be determined uniquely. As this so-called non-uniqueness problem [BMS98] is inevitable in practice, an infinitely large set of possible solutions for the LEMS exists, from which only one corresponds to the true LEMS.

In the past decades, nonlinear [MHBO1] or time-variant [HBK07, SHK13] pre-processing of the loudspeaker signals has been proposed to address the non-uniqueness problem while even slightly increasing the computational burden. On the other hand, the concept of WDAF alleviates both the computational complexity and the non-uniqueness problem [SK14] and is optimum for uniform, concentric, circular loudspeaker and microphone arrays. To this end, WDAF employs a spatial transform which decomposes sound fields into elementary solutions of the acoustic wave equation and allows approximate models and sophisticated regularization in the spatial transform domain [SK14]. Another approach known as Source-Domain Adaptive Filtering (SDAF) [HBSIO] performs a data-driven spatio-temporal transform on the loudspeaker and microphone signals in order to allow an effective modeling of acoustic echo paths in the resulting highly time-varying transform domain. Yet, the identified system does not represent the LEMS, but is a signal dependent approximation. Another adaptation scheme is called Eigenspace Adaptive Filtering (EAF), which is actually approximated by WDAF [SB R06]. In the aforementioned approach, an N 2-channel acoustic MIMO system with $N_L=N_M=N$ would correspond to exactly N paths after transformation of the signals into the system's eigenspace. The method of [HB13] describes an iterative approach for estimating the involved eigenspaces of the LEMS. None of these approaches employs side information from an object-based rendering system. Even WDAF only exploits prior knowledge about a transform-domain LEMS, while assuming special transducer placements (uniform circular concentric loudspeaker and microphone arrays).

SUMMARY

According to an embodiment, a rendering system may have: plurality of loudspeakers; at least one microphone; a signal processing unit; wherein using a rendering filters transfer function matrix a number of virtual sources is reproduced with the plurality of loudspeakers; and wherein the signal processing unit is configured to determine at least some components of a loudspeaker-enclosure-microphone transfer function matrix estimate describing acoustic paths between the plurality of loudspeakers and the at least one microphone using said rendering filters transfer function matrix.

According to another embodiment, a rendering system may have: plurality of loudspeakers; at least one microphone; a signal processing unit; wherein the signal processing unit is configured to estimate at least some components of a source-specific transfer function matrix describing acoustic paths between a number of virtual sources, which are reproduced with the plurality of loudspeakers, and the at least one microphone; and wherein the processing unit is configured to determine at least some components of a loudspeaker-enclosure-microphone transfer function matrix estimate describing acoustic paths between the plurality of loudspeakers and the at least one microphone using the estimated source-specific transfer function matrix.

According to another embodiment, a method may have the steps of: determining at least some components of a loudspeaker-enclosure-microphone transfer function matrix describing acoustic paths between a plurality of loudspeakers and at least one microphone using a rendering filters transfer function matrix, wherein using said rendering filters transfer function matrix a number of source signals is reproduced with the plurality of loudspeakers.

According to another embodiment, a method may have the steps of: estimating at least some components of a source-specific transfer function matrix describing acoustic paths between a number of virtual sources, which are reproduced with a plurality of loudspeakers, and at least one microphone; and determining at least some components of a loudspeaker-enclosure-microphone transfer function matrix estimate describing acoustic paths between the plurality of loudspeakers and the at least one microphone using the estimated source-specific transfer function matrix.

Another embodiment may have a non-transitory digital storage medium having a computer program stored thereon to perform the method having the steps of: determining at least some components of a loudspeaker-enclosure-microphone transfer function matrix describing acoustic paths between a plurality of loudspeakers and at least one microphone using a rendering filters transfer function matrix, wherein using said rendering filters transfer function matrix a number of source signals is reproduced with the plurality of loudspeakers, when said computer program is run by a computer.

Another embodiment may have a non-transitory digital storage medium having a computer program stored thereon to perform the method having the steps of: estimating at least some components of a source-specific transfer function matrix describing acoustic paths between a number of virtual sources, which are reproduced with a plurality of loudspeakers, and at least one microphone; and determining at least some components of a loudspeaker-enclosure-microphone transfer function matrix estimate describing acoustic paths between the plurality of loudspeakers and the at least one microphone using the estimated source-specific transfer function matrix, when said computer program is run by a computer.

According to another embodiment, a rendering system may have: plurality of loudspeakers; at least one microphone; a signal processing unit; wherein the signal processing unit is configured to determine at least some components of a loudspeaker-enclosure-microphone transfer function matrix estimate describing acoustic paths between the plurality of loudspeakers and the at least one microphone using a rendering filters transfer function matrix, wherein using said rendering filters transfer function matrix a number of virtual sources is reproduced with the plurality of loudspeakers; wherein the signal processing unit is configured to estimate at least some components of a source-specific transfer function matrix describing acoustic paths between the number of virtual sources and the at least one microphone; and wherein the processing unit is configured to determine the loudspeaker-enclosure-microphone transfer function matrix estimate using the estimated source-specific signal transfer function matrix.

According to another embodiment, a method may have the steps of: determining at least some components of a loudspeaker-enclosure-microphone transfer function matrix estimate describing acoustic paths between a plurality of loudspeakers and at least one microphone using a rendering filters transfer function matrix, wherein using said rendering filters transfer function matrix a number of virtual sources is reproduced with the plurality of loudspeakers; and estimating at least some components of a source-specific transfer function matrix describing acoustic paths between the number of virtual sources and the at least one microphone, wherein the loudspeaker-enclosure-microphone transfer function matrix estimate is determined using the estimated source-specific signal transfer function matrix.

Embodiments of the present invention provide a rendering system comprising a plurality of loudspeakers, at least one microphone and a signal processing unit. The signal processing unit is configured to determine at least some components of a loudspeaker-enclosure-microphone transfer function matrix estimate describing acoustic paths between the plurality of loudspeakers and the at least one microphone using a rendering filters transfer function matrix using which a number of virtual sources is reproduced with the plurality of loudspeakers.

Further embodiments provide a rendering system comprising a plurality of loudspeakers, at least one microphone and a signal processing unit. The signal processing unit is configured to estimate at least some components of a source-specific transfer function matrix (HS) describing acoustic paths between a number of virtual sources, which are reproduced with the plurality of loudspeakers, and the at least one microphone, and to determine at least some components of a loudspeaker-enclosure-microphone transfer function matrix estimate describing acoustic paths between the plurality of loudspeakers and the at least one microphone using the source-specific transfer function matrix.

According to the concept of the present invention, the computational complexity for identifying a loudspeaker-enclosure-microphone system which can be described by a loudspeaker-enclosure-microphone transfer function matrix can be reduced by using a rendering filters transfer function matrix when determining an estimate of the loudspeaker-enclosure-microphone transfer function matrix. The rendering filters transfer function matrix is available to the rendering system and used by the same for reproducing a number of virtual sources with the plurality of loudspeakers. In addition, instead of directly estimating the loudspeaker-enclosure-microphone transfer function matrix at least some components of a source-specific transfer function matrix describing acoustic paths between the number of virtual sources and the at least one microphone can be estimated and used in connection with the rendering filters transfer function matrix for determining the estimate of the loudspeaker-enclosure-microphone transfer function matrix.

In embodiments, the signal processing unit can be configured to determine the components (or only those components) of the loudspeaker-enclosure-microphone transfer function matrix estimate which are sensitive to a column space of the rendering filters transfer function matrix.

Thereby, the computational complexity for determining the loudspeaker-enclosure-microphone transfer function matrix estimate can further be reduced.

In embodiments, the signal processing unit can be configured to determine at least some components of the loudspeaker-enclosure-microphone transfer function matrix estimate based on the equation $$\hat{H}=\hat{H}_S H_D^+$$

wherein $\hat{H}$ represents the loudspeaker-enclosure-microphone transfer function matrix estimate, wherein $\hat{H}_S$ represents the estimated source-specific transfer function matrix, wherein $H_D$ represents the rendering filters transfer function matrix, and wherein $H_D^+$ represents an approximate inverse of the rendering filters' transfer function matrix $H_D$.

In embodiments, the signal processing unit can be configured to update, in response to a change of at least one out of a number of virtual sources or a position of at least one of the virtual sources, at least some components of the loudspeaker-enclosure-microphone transfer function matrix estimate using a rendering filters transfer function matrix corresponding to the changed virtual sources.

For example, the signal processing unit can be configured to update at least some components of the loudspeaker-enclosure-microphone transfer function matrix estimate based on the equation $$\hat{H}(\kappa|\kappa)=\hat{H}^{\perp}(\kappa|\kappa-1)+\hat{H}_S(\kappa|\kappa)H_D^+(\kappa)$$

wherein $\kappa-1$ denotes a previous time interval, wherein $\kappa$ denotes a current time interval, wherein between the previous time interval and the current time interval at least one out of a number of virtual sources and a position of at least one of the virtual sources is changed, wherein $\hat{H}(\kappa|\kappa)$ represents a loudspeaker-enclosure-microphone transfer function matrix estimate, $\hat{H}^{\perp}(\kappa|\kappa-1)$ represents components of the loudspeaker-enclosure-microphone transfer function matrix estimate which are not sensitive to the column space of the rendering filters transfer function matrix, $\hat{H}_S(\kappa|\kappa)$ represents an estimated source-specific transfer function matrix, and wherein $H_D^+(\kappa)$ represents an inverse rendering filters transfer function matrix.

Further, the signal processing unit can be configured to update at least some components of the loudspeaker-enclosure-microphone transfer function matrix estimate based on the equation $$\hat{H}(\kappa|\kappa)=\hat{H}(\kappa|\kappa-1)+(\hat{H}_S(\kappa|\kappa)-\hat{H}_S(\kappa|\kappa-1))H_D^+(\kappa)$$

wherein $\kappa-1$ denotes a previous time interval, wherein $\kappa$ denotes a current time interval, wherein between the current time interval and the previous time interval at least one out of a number of virtual sources and a position of at least one of the virtual sources is changed, wherein $\hat{H}(\kappa|\kappa)$ represents a loudspeaker-enclosure-microphone transfer function matrix estimate, wherein $\hat{H}(\kappa|\kappa-1)$ represents a loudspeaker-enclosure-microphone transfer function matrix estimate, $\hat{H}_S(\kappa|\kappa)$ represents an estimated source-specific transfer function matrix, wherein $\hat{H}(\kappa|\kappa-1)$ represents a loudspeaker-enclosure-microphone transfer function matrix estimate, and wherein $H_D^+(\kappa)$ represents an inverse rendering filters transfer function matrix.

Therewith, an average load of the signal processing unit can be reduced which can be advantageous for computationally powerful devices which have limited electrical power resources, such as multicore smartphones or tablets, or devices which have to perform other, less time-critical tasks in addition to the signal processing.

Further, the signal processing unit can be configured to update at least some components of the loudspeaker-enclosure-microphone transfer function matrix estimate based on the distributedly evaluated equation $$\hat{H}(\kappa|\kappa-1)=\hat{H}(\kappa-1|\kappa-2)+\hat{H}_S^{\Delta}(\kappa-1)H_D^+(\kappa-1)$$

as part of an initialization of a following interval's estimated source-specific transfer function matrix by $$\hat{H}_S(\kappa+1|\kappa)=(\hat{H}(\kappa-1|\kappa-2)+\hat{H}_S^{\Delta}(\kappa-1)H_D^+(\kappa-1))H_D(\kappa+1)+\hat{H}_S^{\Delta}(\kappa)H_T^{(\kappa,\kappa+1)}$$

wherein $\kappa-2$ denotes a second previous time interval, wherein $\kappa-1$ denotes a previous time interval, wherein $\kappa$ denotes a current time interval, wherein $\kappa+1$ denotes a following time interval, wherein between the time intervals at least one out of a number of virtual sources and a position of at least one of the virtual sources is changed, wherein $\hat{H}(\kappa|\kappa-1)$ represents a loudspeaker-enclosure-microphone transfer function matrix estimate, $\hat{H}_S(\kappa+1|\kappa)$ represents an estimated source-specific transfer function matrix, wherein $\hat{H}(\kappa-1|\kappa-2)$ represents a loudspeaker-enclosure-microphone transfer function matrix estimate, wherein $\hat{H}_S^{\Delta}(\kappa-1)$ represents an update of an estimated source-specific transfer function matrix, $H_D^+(\kappa-1)$ represents an inverse rendering filters transfer function matrix, $H_D(\kappa+1)$ represents a rendering filters transfer function matrix, $\hat{H}_S^{\Delta}(\kappa)$ represents an update of an estimated source-specific transfer function matrix, and wherein $H_T^{(\kappa,\kappa+1)}$ represents a transition transform matrix which describes an update of an estimated source-specific transfer function matrix of the current time interval to the following time interval, such that only a contribution of $\hat{H}_S^{\Delta}(\kappa)H_T^{(\kappa,\kappa+1)}$ is computed between two time intervals.

This is advantageous for the identification of very large systems, in case of computationally less powerful processing devices, or when sharing one processing device with other time-critical applications (e.g., head units of a car), the peak load produced by the signal processing application is to be reduced.

Different to all common approaches, embodiments employ prior information from an object-based rendering system (e.g., statistically independent source signals and the corresponding rendering filters) in order to reduce the computational complexity and, although the LEMS cannot be determined uniquely, to allow for a unique solution of the involved adaptive filtering problem. Even more, some embodiments provide a flexible concept allowing either a minimization of the peak or the average computational complexity.

Further embodiments provide a method comprising a step of determining a loudspeaker-enclosure-microphone transfer function matrix describing acoustic paths between a plurality of loudspeakers and at least one microphone using a rendering filters transfer function matrix using which a number of source signals is reproduced with the plurality of loudspeakers.

Further embodiments provide a method comprising a step of estimating at least some components of a source-specific transfer function matrix describing acoustic paths between a number of virtual sources, which are reproduced with a plurality of loudspeakers, and at least one microphone, and a step of determining at least some components of a loudspeaker-enclosure-microphone transfer function matrix estimate describing acoustic paths between the plurality of loudspeakers and the at least one microphone using the source-specific transfer function matrix.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
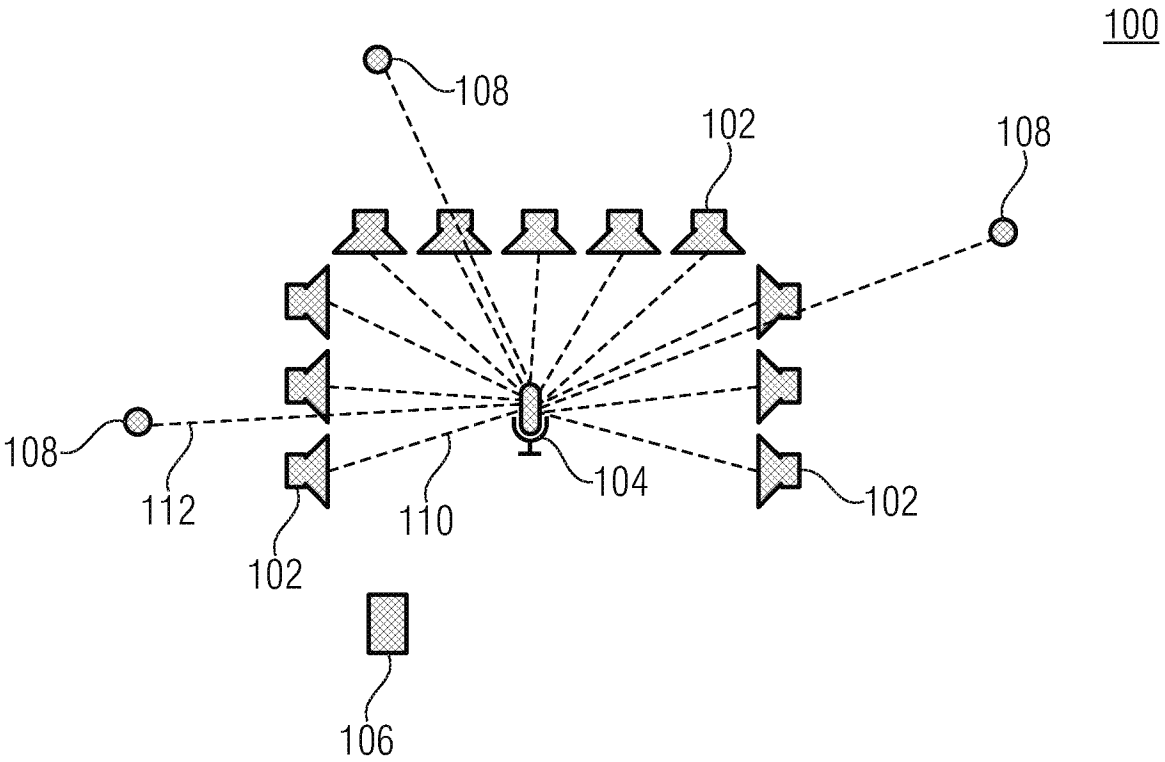
FIG. 1 shows a schematic block diagram of a rendering system, according to an embodiment of the present invention.

Equal or equivalent elements or elements with equal or equivalent functionality are denoted in the following description by equal or equivalent reference numerals.

In the following description, a plurality of details are set forth to provide a more thorough explanation of embodiments of the present invention. However, it will be apparent to one skilled in the art that embodiments of the present invention may be practiced without these specific details. In other instances, well-known structures and devices are shown in block diagram form rather than in detail in order to avoid obscuring embodiments of the present invention. In addition, features of the different embodiments described hereinafter may be combined with each other unless specifically noted otherwise.

FIG. 1 shows a schematic block diagram of a rendering system 100 according to an embodiment of the present invention. The rendering system 100 comprises a plurality of loudspeakers 102, at least one microphone 104 and a signal processing unit 106. The signal processing unit 106 is configured to determine at least some components of a loudspeaker-enclosure-microphone transfer function matrix estimate $\hat{H}$ describing acoustic paths 110 between the plurality of loudspeakers 102 and the at least one microphone 104 using a rendering filters transfer function matrix $H_D$ using which a number of virtual sources 108 is reproduced with the plurality of loudspeakers 102.

In embodiments, the signal processing unit 106 can be configured to use the rendering filters transfer function matrix $H_D$ for calculating individual loudspeaker signals (or signals that are to be reproduced by the individual loudspeakers 102) from source signals associated with the virtual sources 108. Thereby, normally, more than one of the loudspeakers 102 is used for reproducing one of the source signals associated with the virtual sources 108. The signal processing unit 106 can be, for example, implemented by means of a stationary or mobile computer, smartphone, tablet or as dedicated signal processing unit.

The rendering system can comprise up to $N_L$ Loudspeakers 102, wherein $N_L$ is a natural number greater than or equal to two, $N_L \geq 2$. Further, the rendering system can comprise up to $N_M$ microphones, wherein $N_M$ is a natural number greater than or equal to one, $N_M \geq 1$. The number $N_S$ of virtual sources may be equal to or greater than one, $N_S \geq 1$. Thereby, the number $N_S$ of virtual sources is smaller than the number $N_L$ of loudspeakers, $N_S < N_L$.

In embodiments, the signal processing unit 106 can be further configured to estimate at least some components of a source-specific transfer function matrix $H_S$ describing acoustic paths 112 between the number of virtual sources 108 and the at least one microphone 104, to obtain a source-specific transfer function matrix estimate $\hat{H}_S$. Thereby, the processing unit 106 can be configured to determine the loudspeaker-enclosure-microphone transfer function matrix estimate $\hat{H}$ using the source-specific signal transfer function matrix estimate $\hat{H}_S$.

In the following, embodiments of the present invention will be described in further detail. Thereby, the idea of estimating the source-specific transfer function matrix (HS) and using the same for determining the loudspeaker-enclosure-microphone transfer function matrix estimate $\hat{H}$ will be referred to as source-specific system identification.

In other words, subsequently embodiments of the source-specific system identification (SSSysid) and embodiments allowing either a minimization of the peak or the average computational complexity, based on embodiments of the source-specific system identification, will be described. While embodiments of the source-specific system identification allow a unique and efficient filter adaptation and provide the mathematical foundation for deriving a valid LEMS estimate from the identified filters, embodiments of average- and peak-load-optimized systems allows a flexible, application-specific use of processing resources.

Consider an object-based rendering system, i.e. WFS [SRA08], which renders $N_S$ statistically independent virtual sound sources (e.g., point sources, plane-wave sources) employing an array of $N_L$ loudspeakers. To allow for a voice control of an entertainment system or an additional use of the reproduction system as hands-free front-end in a communication scenario, a set of $N_M$ microphones for sound acquisition and an AEC unit may be used. The acoustic paths between the loudspeakers and $N_M$ microphones of interest can be described as linear systems with discrete-time Fourier transform (DTFT) domain transfer function matrices $H(e^{j\Omega}) \in \mathbb{C}^{N_M \times N_L}$ with the normalized angular frequency $\Omega$. For the sake of brevity of notation, the argument $\Omega$ will be neglected for all signal vectors and transfer function matrices, which means that H stands for $H(e^{j\Omega})$. This notation is employed in FIG. 2, which depicts the vector of DTFT-domain source signals $s \in \mathbb{C}^{N_S}$, the rendering filters' transfer function matrix $H_D \in \mathbb{C}^{N_L \times N_S}$, the loudspeaker signals $x_L = H_D s \in \mathbb{C}^{N_L}$, the LEMS transfer function matrix H, and the microphone signal vector $$x_{Mic} = Hx_L = \underbrace{HH_D}_{H_S} s,$$

where the cascade of the rendering filters with the LEMS will be referred to as source-specific system $$H_S = HH_D \in \mathbb{C}^{N_M \times N_S}. \tag{1}$$

Figure 3:
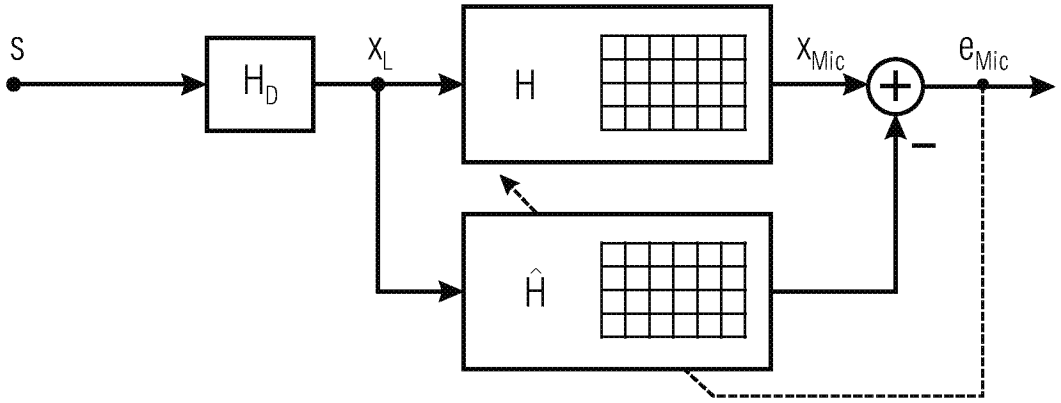
FIG. 3 shows a schematic block diagram of signal paths conventionally used for estimating the loudspeaker-enclosure-microphone transfer function matrix (LEMS H)

Both for recording near-end sources only (involving an AEC unit) and for room equalization, the LEMS H can be identified adaptively. This can be done by minimizing a quadratic cost function derived from the difference $e_{Mic}$ between the recorded microphone signals $x_{Mic}$ and the microphone signal estimates obtained with the LEMS estimate $\hat{H}$, as depicted in FIG. 3. Thereby, in FIG. 3, the number of squares symbolizes the number of filter coefficients to estimate.

As mentioned before, multichannel acoustic system identification suffers from the strongly cross-correlated loudspeaker signals typically occurring when rendering acoustic scenes with more than one loudspeaker: for more loudspeakers than virtual sources ($N_L > N_S$), the acoustic paths of the LEMS H cannot be determined uniquely ('non-unique ness problem' [BMS98]). This means that an infinitely large set of possible solutions for H exists, from which only one corresponds to the true LEMS H.

Figure 2:
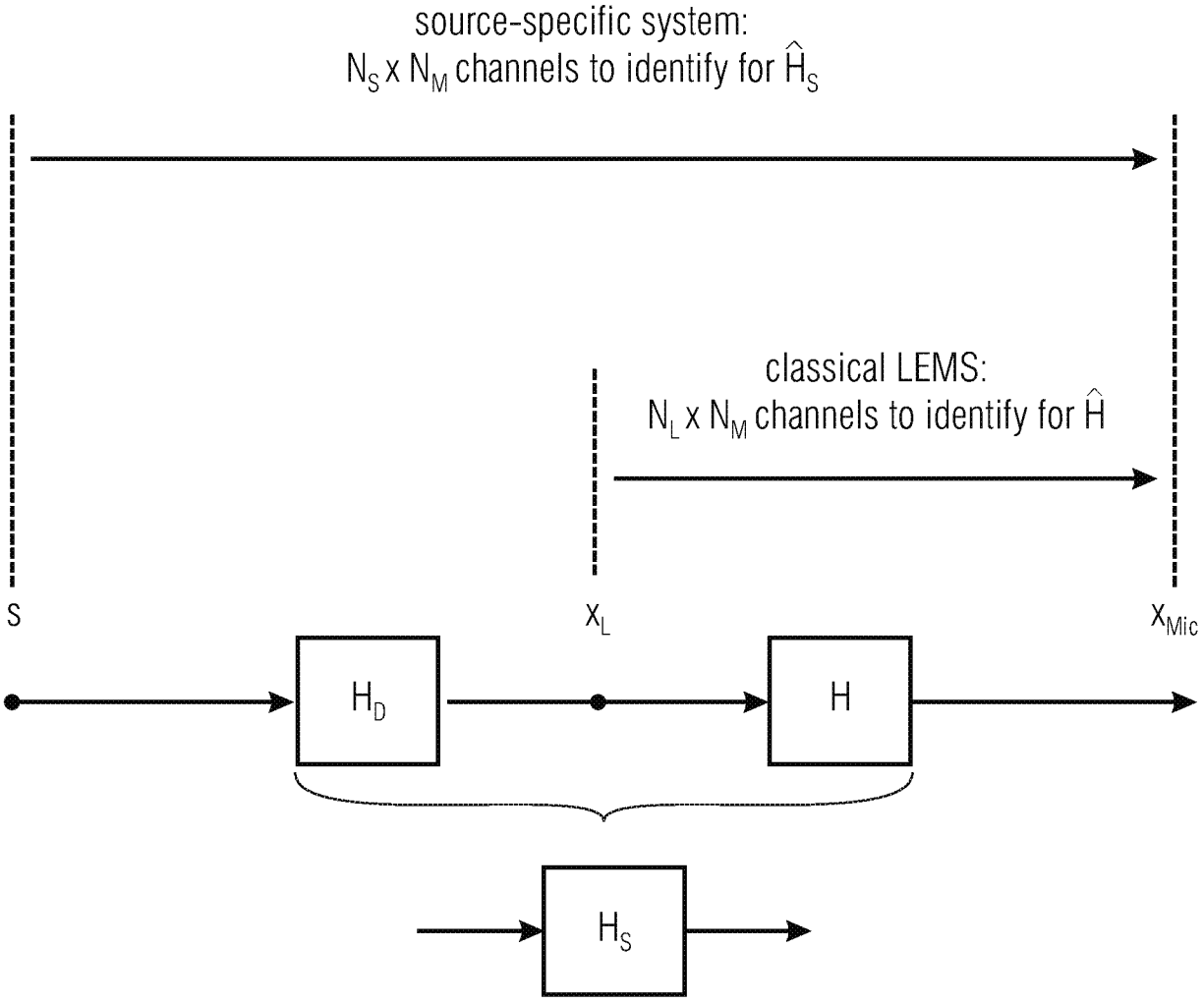
FIG. 2 shows a schematic diagram of a comparison of paths to be modeled by a classical loudspeaker-enclosure-microphone systems identification and by a source-specific system identification according to an embodiment.
Figure 4:
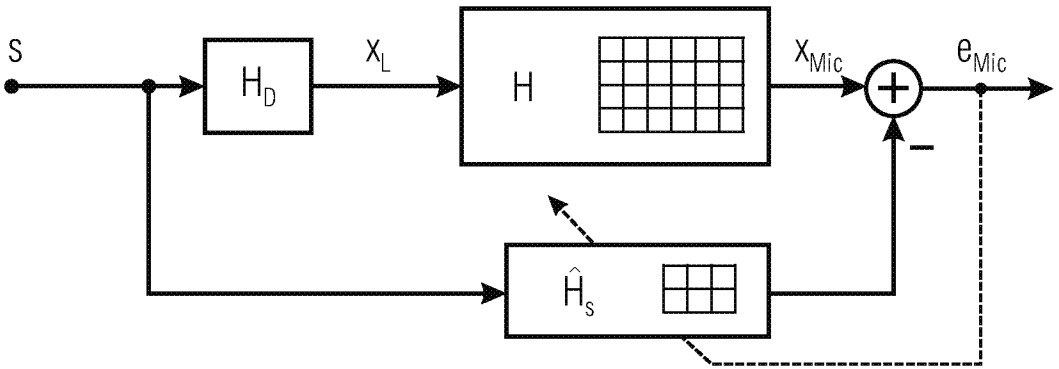
FIG. 4 shows a schematic block diagram of signal paths used for estimating the source-specific transfer function matrix (source-specific system $H_S$), according to an embodiment.

As opposed to this, the paths from each virtual source to each microphone can be described as an $N_S \times N_M$ MIMO system $H_S$ (marked in FIG. 2 by the curly brace) which can be determined uniquely for the given set of statistically independent virtual sources (the assumption of statistical independence even holds if the sources are instruments or persons performing the same song). Due to the statistical independence of the virtual sources, the computational complexity of the system identification with a GFDAF algorithm increases only linearly with $N_S$ instead of cubically with $N_L$, as the covariance matrices to invert become diagonal. Furthermore, the number of acoustic paths to be modeled is reduced by a factor of $N_S/N_L$. Hence, an estimate for $\hat{H}_S$ can be obtained as depicted in FIG. 4 very accurately and with less effort than an estimate for $\hat{H}$ according to FIG. 3. Thereby, in FIG. 3, the number of squares symbolizes the number of filter coefficients to estimate. The systems to be identified and the respective estimates are indicated in FIG. 2 above the block diagrams.

Although $\hat{H}$ is not determined uniquely by $\hat{H}_S$ in general, the non-uniqueness of this mapping is exactly the same as the non-uniqueness problem for determining $\hat{H}$ directly and finding one of the systems $\hat{H}$ is easily possible by approximating an inverse rendering system $H_D^+$ and pre-filtering the source-specific system $\hat{H}_S$ to obtain one particular $$\hat{H}=\hat{H}_S H_D^+. \tag{2}$$

Hence, a statistically optimal estimate $\hat{H}$, which also could have been the result from adapting $\hat{H}$ directly, can be obtained by identifying $H_S$ by an $\hat{H}_S$ with very low effort and without non-uniqueness problem and transforming $\hat{H}_S$ into an estimate of $\hat{H}$ in a systematic way. This can be seen as exploiting non-uniqueness rather than seeing it as a problem: if it is impossible to infer the true system anyway, the effort for finding one of the solutions should be minimized.

Subsequently, determining an LEMS estimate from a Source-Specific System Estimate will be described. In other words, a suitable mapping from a source-specific system to an LEMS corresponding to the source-specific system will be described. For given source-specific transfer function estimates $\hat{H}_S$, the concatenation of the driving filters with the LEMS estimate $\hat{H}$ should fulfill $\hat{H}H_D \overset{!}{=} \hat{H}_S$, analogously to Eq. (1). For the typical case of less synthesized sources than loudspeakers ($N_S<N_L$), this linear system of equations does not allow a unique solution for $\hat{H}$—an inverse $H_D^{-1}$ does not exist. However, the minimum-norm solution can be obtained by the Moore-Penrose pseudoinverse [Str09]. Note that the rendering system's driving filters and their inverses are determined during the production of the audio material and can be calculated at the production stage as already. Hence, the LEMS estimate can then be computed from the source-specific transfer functions according to Eq. (2) by pre-filtering $H_S$. For a driver matrix $H_D$ with pseudoinverse $H_D^+$, $$P=H_D=H_D^+$$

$$P^{\perp}=(I-P)$$

are known as the projectors into the column space of $H_D$ and into the left null space of $H_D$, respectively [Str09]. These two matrices decompose the $N_L$-dimensional space into two orthogonal subspaces. With this, the LEMS H can be expressed as sum of two orthogonal components $$\begin{aligned} H &= \overbrace{HP}^{H^{\parallel}} + \overbrace{H(I-P)}^{H^{\perp}} \\ &= HH_D H_D^+ + H(I-P) \\ &= H_S H_D^+ + H^{\perp}, \end{aligned} \tag{3}$$

where $H^{\parallel}=H_S H_D^+$ is a filtered version of the source-specific system $H_S$ and $H^{\perp}$ lies in the left null space of $H_D$ and is not excited by the latter. Therefore, $H^{\perp}$ is not observable at the microphones and represents the ambiguity of the solutions for $\hat{H}$ (non-uniqueness problem). Whenever $H_D^+$ is employed to map a source-specific system back to an LEMS estimate, the estimate's rows will lie in the column space of $H_D$ and all components in the left null space of $H_D$, namely $H^{\perp}$, are implied to be zero (0).

Hence, only the LEMS components sensitive to the column space of $H_D$ can and should be estimated from a particular $H_S$. This idea will be employed in the following to extend source-specific system identification for time-varying virtual acoustic scenes.

In practice, the number and the positions of virtual acoustic sources may change over time. Thus, the rendering task can be divided into a sequence of intervals with different, but internally constant virtual source configuration. These intervals can be indexed by the interval index K, where K is an integer number. At the beginning of an interval κ, an initial source-specific system estimate $$\hat{H}_S(\kappa|\kappa-1)=\hat{H}(\kappa|\kappa-1)H_D(\kappa) \tag{4}$$

can be computed from the information available from observing the interval κ−1, namely the initial LEMS estimate $\hat{H}(\kappa|\kappa-1)=\hat{H}(\kappa-1|\kappa-1)$ can be obtained from interval κ−1, and the current interval's rendering filters $H_D(\kappa)$. After adapting only the source-specific system $\hat{H}_S$ during interval κ, a final source-specific system estimate $\hat{H}_S(\kappa|\kappa)$ is available at the end of interval κ. Embodying the idea to update only $H^{\parallel}$ and keep $\hat{H}^{\perp}(\kappa|\kappa-1)=\hat{H}(\kappa|\kappa-1)(I-H_D(\kappa)H_D^+(\kappa))$ unaltered during a particular interval κ, this can be formulated as $$\hat{H}(\kappa|\kappa)=\hat{H}^{\perp}(\kappa|\kappa-1)+\hat{H}_S(\kappa|\kappa)H_D^+(\kappa).$$

Figure 5:
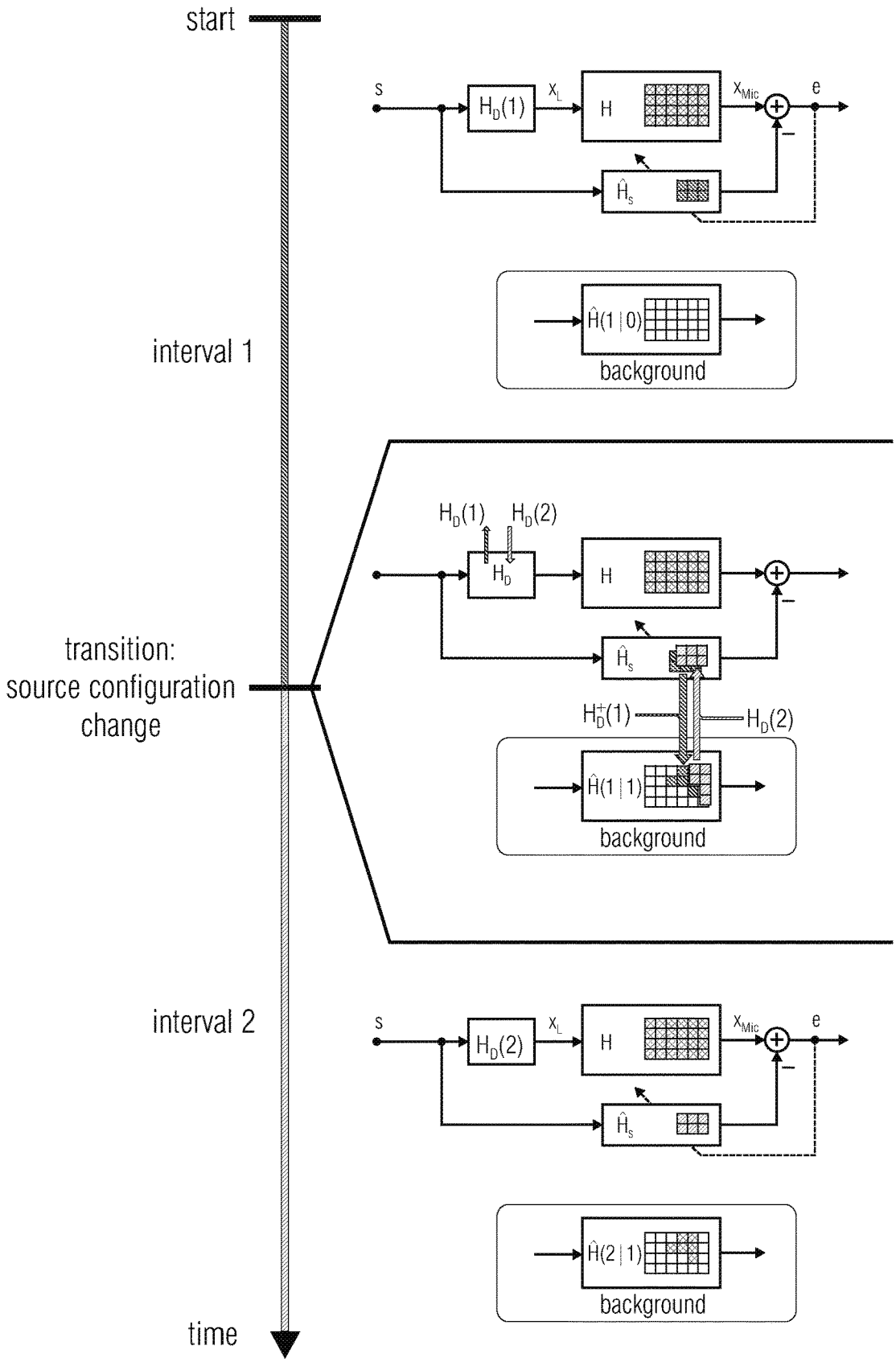
FIG. 5 shows a schematic diagram of an example for efficient identification of an LEMS by identifying source-specific systems during intervals of constant source configuration and knowledge transfer between different intervals by means of a background model of the LEMS, where the identified system components accumulate.

This can be shown to correspond to a minimum-norm update $$\begin{aligned} \hat{H}^{\Delta}(\kappa) &= \hat{H}(\kappa|\kappa) - \hat{H}(\kappa|\kappa-1) \\ &= (\hat{H}_S(\kappa|\kappa) - \hat{H}_S(\kappa|\kappa-1))H_D^+(\kappa), \end{aligned} \tag{5}$$

the smallest update which leads to $\hat{H}_S(\kappa|\kappa)$. As this procedure leaves $H^{\perp}$ unaltered ($H^{\perp}(\kappa|\kappa)=H^{\perp}(\kappa|\kappa-1)$), information about the true LEMS can accumulate over all intervals, allowing a continuous refinement of $\hat{H}$ in case of time-varying acoustic scenes. FIG. 5 outlines this idea for a typical situation. To this end, two time Intervals 1 and 2 are considered, within which the virtual source configurations do not change. But, the virtual source configurations of both intervals are different. Furthermore, the whole system is switched on at the beginning of Interval 1. This is also depicted in the time line (left) in FIG. 5. The transition from Interval 1 to 2 is indicated at the time line by the label "Transition". To the right of the time line, the adaptive system identification process during Intervals 1 and 2 is illustrated at the top and bottom, respectively. In between, the operations performed during the source-configuration change are visualized. Each of the squares in the system blocks represents a subsystem of fixed size. Consequently, the number of squares is proportional to the size of the linear system itself. In the following, the intervals will be explained in chronological order.

First, interval 1. At the beginning of interval 1 ("Start" in FIG. 5), the estimate $\hat{H}$ for the LEMS H is still all zero (indicated by white squares) and it remains like this for the whole interval. On the other hand, after obtaining an initial source-specific system $\hat{H}_S(0|0)$ via Eq. (4), the source-specific system $\hat{H}_S$ is continuously adapted during this interval, leading to the final estimate $\hat{H}_S(1|1)$.

Second, the transition between intervals 1 and 2. At the transition between intervals 1 and 2 (center part of FIG. 5), the virtual source configuration changes. Thus, the driving system is exchanged to allow rendering a different virtual scene ($H_D(1)$ is replaced by $H_D(2)$) and information from $\hat{H}_S$ is transferred to $\hat{H}$. For this knowledge transfer, the pseudo-inverse $H_D^+(1)$ of the driving system $H_D(1)$ is employed. From the updated LEMS estimate $\hat{H}(2|1)=\hat{H}(1|1)$ and the new driving filters $H_D(2)$, an initialization $\hat{H}_S(2|1)$ for $\hat{H}_S$ for the Interval 2 is obtained via Eq. (4).

Third, interval 2. Analogously to interval 1, only a small source-specific system is adapted within interval 2 (bottom). Yet, an estimate $\hat{H}$ is available in the background (system components contributed by interval 1 are gray now). In case of another scene change (exceeds time line in FIG. 5), $\hat{H}_S(2|2)$ can then refine the LEMS estimate $\hat{H}$ again, leading to an even better initialization for the subsequent interval's source-specific system. Thereby, all intervals with different source configurations contribute to the estimation of the LEMS and support the initialization of the adaptive source-specific systems in case of previously observed and unobserved source configurations.

In the following, embodiments which reduce (or even minimize) a peak computational load or an average computational load for system identification will be described.

Thinking about computationally powerful devices with limited electrical power resources (e.g., multicore tablets or smartphones) or devices which have to perform other, less time-critical tasks in addition to the signal processing, a minimization of the average computational load for the adaptive filtering is desirable. On the other hand, for the identification of very large systems, in case of computationally less powerful processing devices, or when sharing one processing device with other time-critical applications (e.g., head units of a car), the peak load produced by signal processing application is to be reduced. Thus, the idea of a generic concept allowing either average load or peak load minimization is combined with the idea of source-specific system identification in the following.

Figure 6:
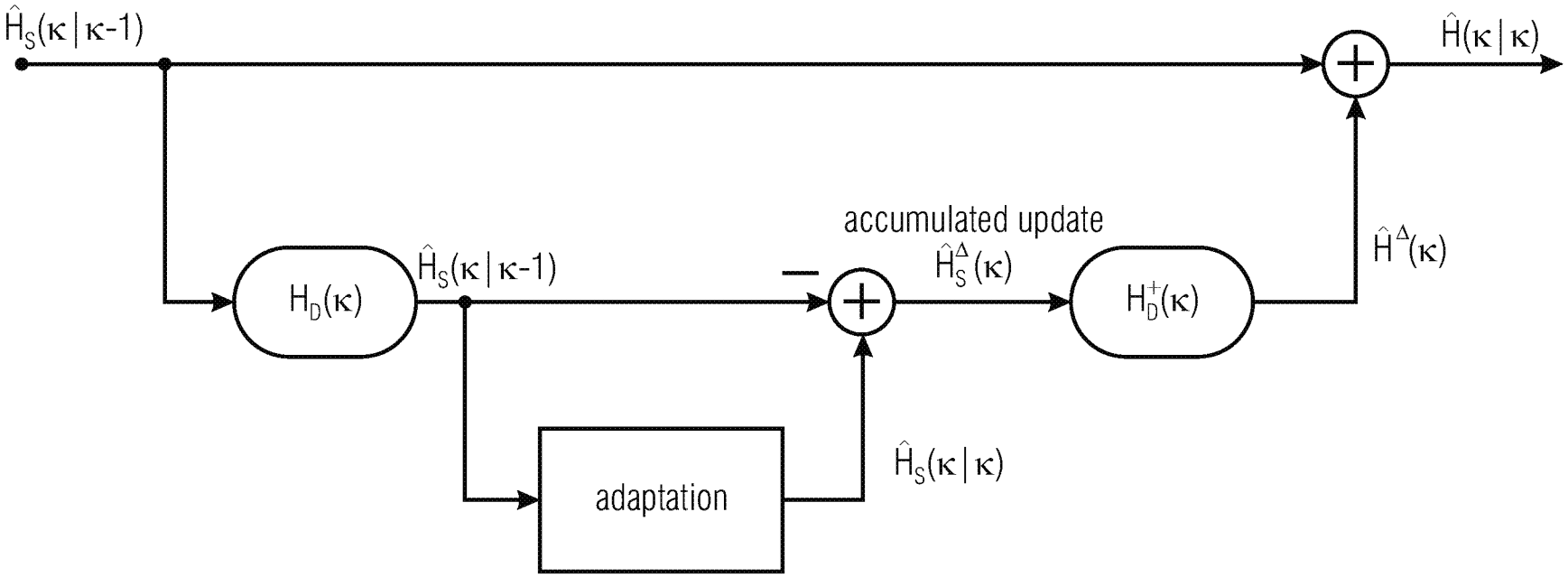
FIG. 6 shows a schematic block diagram of signal paths used for an average-load-optimized system identification, according to an embodiment.

In order to reduce the average load, the update can directly be computed as described above with respect to the time-varying virtual acoustic scenes, which leads to an efficient update equation $$\hat{H}(\kappa|\kappa)=\hat{H}(\kappa|\kappa-1)+(\hat{H}_S(\kappa|\kappa)-\hat{H}_S(\kappa|\kappa-1))H_D^+(\kappa), \tag{6}$$

for which the operations on an LEMS estimate are outlined in FIG. 6. Thereby, in FIG. 6, the lines represent coefficients of MIMO systems and rounded boxes symbolize pre-filtering the connected incoming coefficients with the MIMO system in the box. Note that the average load is very low due to the low-dimensional adaptation, but the peak load at the scene change is increased due to transformations between source-specific systems and LEMS representations.

A peak-load optimization can be obtained by the idea of splitting the SSSysId update into a component directly originating from the most recent interval's source specific system (to be computed at the scene change) and another component which solely depends on information available one scene change before (pre-computable).

Figure 7:
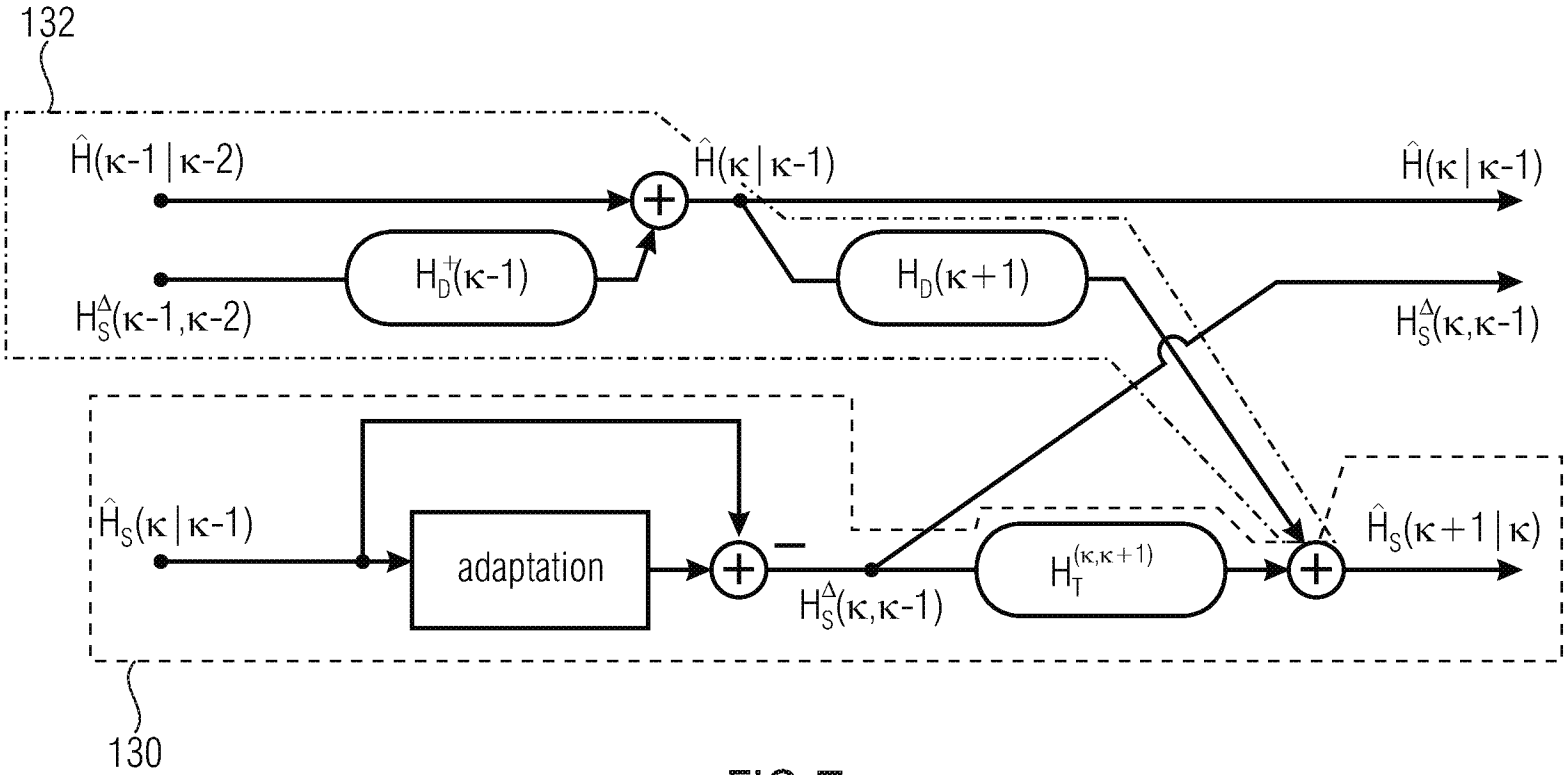
FIG. 7 shows a schematic block diagram of signal paths used for a peak-load-optimized system identification, according to an embodiment.

Doing so after inserting the above described update (Eq. (6)) in Eq. (4) leads to $$\hat{H}_S(\kappa+1|\kappa)=\underbrace{\hat{H}(\kappa|\kappa-1)H_D(\kappa+1)}_{precomputable\ distributedly}+\hat{H}_S^{\Delta}(\kappa)\underbrace{H_T^{(\kappa,\kappa+1)}}_{known} \tag{7}$$

$$=\overbrace{(\hat{H}(\kappa-1|\kappa-2)+H_S^{\Delta}(\kappa-1)H_D^{+}(\kappa-1))}^{\hat{H}(\kappa|\kappa-1)}H_D(\kappa+1)+\hat{H}_S^{\Delta}(\kappa)H_T^{(\kappa,\kappa+1)} \tag{8}$$

with the transition transform from matrix $H_T^{(\kappa,\kappa+1)}=H_D^+(\kappa)H_D(\kappa+1)$ which maps the update of a source-specific system of interval $\kappa$ to an update for a source-specific system in interval $\kappa+1$. The benefit of this formulation is becomes obvious from the adaptation scheme depicted in FIG. 7. In FIG. 7, operations performed on and with system estimates in an interval $\kappa$ of constant virtual source configuration are shown. Thereby, the lines represent coefficients of MIMO systems and rounded boxes symbolize pre-filtering the connected incoming coefficients with the MIMO system in the box.

Further, in FIG. 7, the parts 130 are time-critical and need to be computed in a particular frame (adaptation of the source-specific system and computation of the contribution from $\hat{H}_S(\kappa|\kappa)$ to $\hat{H}_S(\kappa+1|\kappa)$), while the parts 132 (employing $\hat{H}(\kappa-1|\kappa-2)$ and $H_S^{\Delta}(\kappa-1)$ determine $\hat{H}(\kappa|\kappa-1)$ and computation of the contribution from $\hat{H}(\kappa|\kappa-1)$ to $\hat{H}_S(\kappa+1|\kappa)$) can be computed in a distributed way during the complete interval $\kappa$. Afterwards, $\hat{H}(\kappa|\kappa-1)$, $H_S^{\Delta}(\kappa,\kappa-1)$, and $\hat{H}_S(\kappa+1|\kappa)$ are handed over to the next interval.

Note that both the peak-load optimized and the average-load optimized SSSysId mathematically lead to identical LEMS estimates (up to the machine precision). The total computational overhead of the peak-load optimized scheme with respect to the average-load optimized is caused by the additional transform by $H_T^{(\kappa,\kappa+1)}$, which is negligible for long time intervals with constant virtual source configuration.

The lack of side information (virtual source signals and rendering filters or rendering filter computation strategy from other side information) when deploying audio material for a particular rendering system precludes the use of this approach. If the side information cannot be excluded to be available during system identification, a strong evidence for the use of this method can be obtained from the computational load of the system identification process in an AEC application: rendering a single virtual source for a very long time, the computational load caused by the adaptive filtering becomes very low and independent of the number of loudspeakers, which contradicts classical system identification approaches. If this holds, distinguishing between SSSysId and SDAF is needed. To this end, a static virtual scene with more than one virtual source with independently time-varying spectral content can be synthesized: while SSSysId produces constant computational load, the computational load of SDAF will peak repeatedly due to the purely data-driven trans-forms for signals and systems. Another approach for distinguishing SSSysId from SDAF would be to alternate between signals with orthogonal loudspeaker-excitation pattern (e.g. virtual point sources at the positions of different physical loudspeakers): the Echo-Return Loss Enhancement (ERLE) can be expected to break down similarly for every scene change for SDAF, while SSSysId exhibits a significantly lowered breakdown when performing a previously observed scene-change again. However, these tests involve at least access to the load statistics of a processor running the aforementioned rendering tasks.

Figure 8:
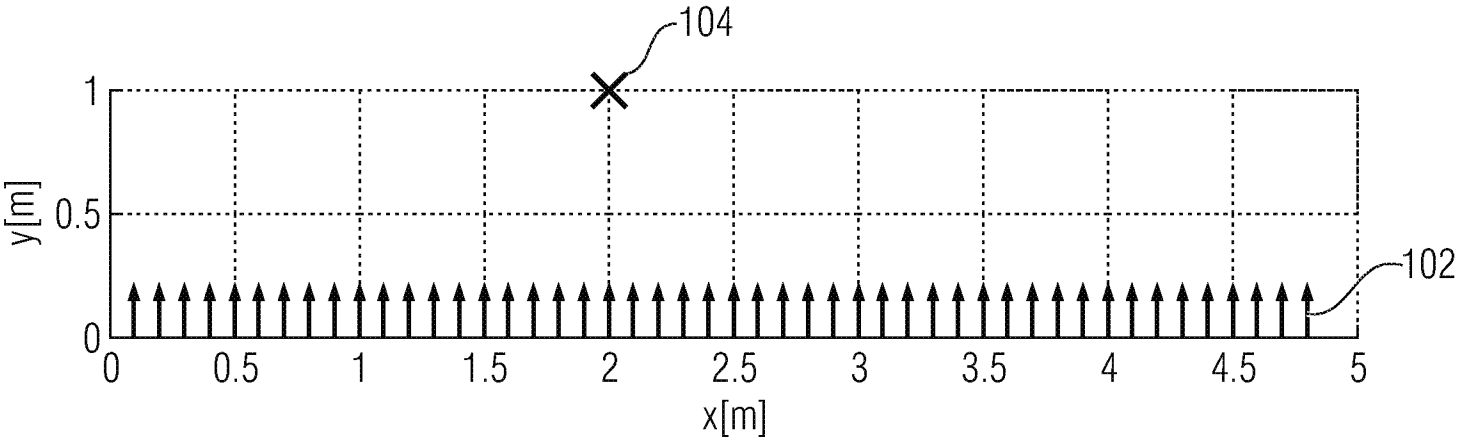
FIG. 8 shows a schematic block diagram of a spatial arrangement of a rendering system with 48 loudspeakers and one microphone, according to an embodiment.

In the following, a verification and evaluation of the basic properties of the SSSysId adaptation scheme are provided by simulating a WFS scenario with a linear sound bar of $N_L$=48 loudspeakers in front of a single microphone (the use of just a single microphone is sufficient for general analyses of the behavior of the adaptation concept as filter adaptation is performed independently for each microphone, anyway) under free-field conditions, as depicted in FIG. 8. In detail, FIG. 8 shows a transducer setup common for the simulation of a prototype with $N_L$=48 loudspeakers 102 and $N_M$=1 microphone.

The WFS system synthesizes at a sampling rate of 8 kHz one or more simultaneously active virtual point sources radiating statistically independent white noise signals. Besides, high-quality microphones are assumed by introducing additive white Gaussian noise at a level of −60 dB to the microphones. The system identification is performed by a GFDAF algorithm. The rendering systems' inverses are approximated in the Discrete Fourier Transform (DFT) domain and a causal time-domain inverse system is obtained by applying a linear phase shift, an inverse DFT, and subsequent windowing.

For numerical stability, the pseudoinverse is approximated in the DFT domain by a Tikhonov regularized inverse $H_D^{+Tik}=(H_D^H H_D+\lambda I)^{-1} H_D^H$ with a regularization constant $\lambda$=0.005, thereby offering a trade-off between the accuracy of the inversion (small $\lambda$) and the filter coefficient norm for ill-conditioned $H_D$. To evaluate the simulations, the normalized residual error signal $$\Delta_e(k) = 10\log_{10}\left(\frac{e(k)^H e(k)}{x_{Mic}(k)^H x_{Mic}(k)}\right) \text{dB},$$

Where $x_{Mic}(k)\in\mathbb{C}^{N_M}$ denotes the vector of microphone samples for the discrete-time sample index k and $e(k)\in\mathbb{C}^{N_M}$ denotes the corresponding vector of error signals, assesses how well the actual microphone signals can be modeled (this corresponds to the inverse of the commonly used ERLE measure in AEC). In order to measure how well the LEMS is identified, we employ the normalized system error norm $$\Delta_h(k) = 10\log_{10}\left(\frac{\sum_{\mu=0}^{L-1}\|\hat{H}_\mu(\kappa|\kappa) - H_\mu\|_F^2}{\sum_{\mu=0}^{L-1}\|H_\mu\|_F^2}\right) \text{dB},$$

Where $H_\mu$ and $\hat{H}_\mu(\kappa|\kappa)$ are DFT-domain transfer function matrices of the estimated and the true LEMS, $\mu\in\{0, \ldots, L-1\}$ is the DFT bin index, and L is the DFT order.

In the following, two different experiments will be described.

Figure 9A:
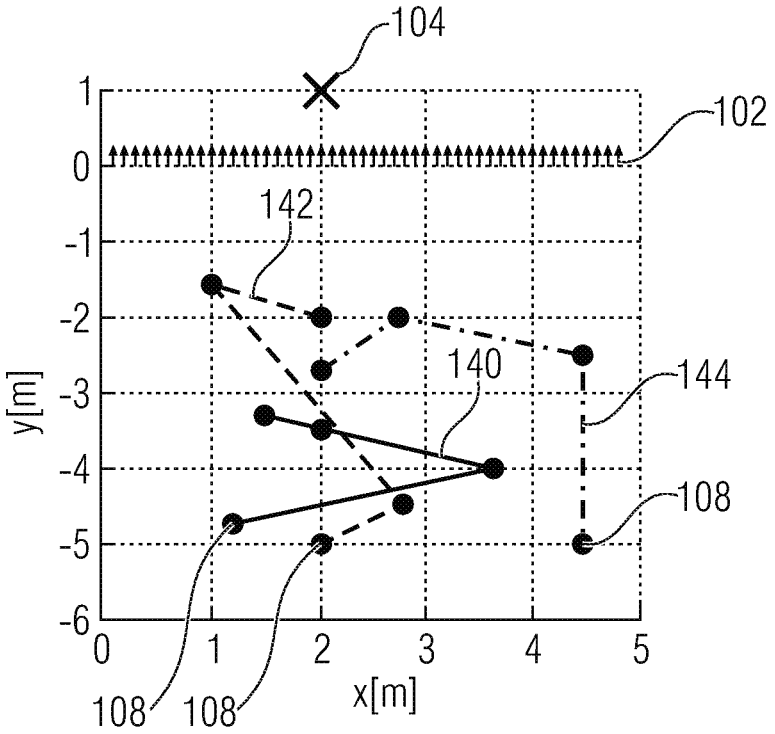
FIG. 9A shows a schematic block diagram of a spatial arrangement of a rendering system with 48 loudspeakers and one microphone, according to an embodiment.

According to a first experiment, 24 s of the microphone signal are synthesized, which are divided into three intervals of length 8 s with different, but internally constant virtual source configurations. The three interval's groups of virtual sources are depicted in FIG. 9A. In detail, in FIG. 9A a schematic block diagram of a setup of $N_L$=48 loudspeakers 102 (arrows), $N_M$=1 microphone (cross), and 3 randomly chosen groups 140,142,144 of 4 virtual sources 108 are shown. Their positions are marked by dots and are connected by a line to symbolize their simultaneous activity. Further, each virtual source 108 is marked by a filled circle and the sources belonging to the same interval of constant source configuration are connected by lines of the same type, i.e., a straight line 140, a dashed line 142 of a first type and a dashed line 144 of a second type.

Figure 9B:
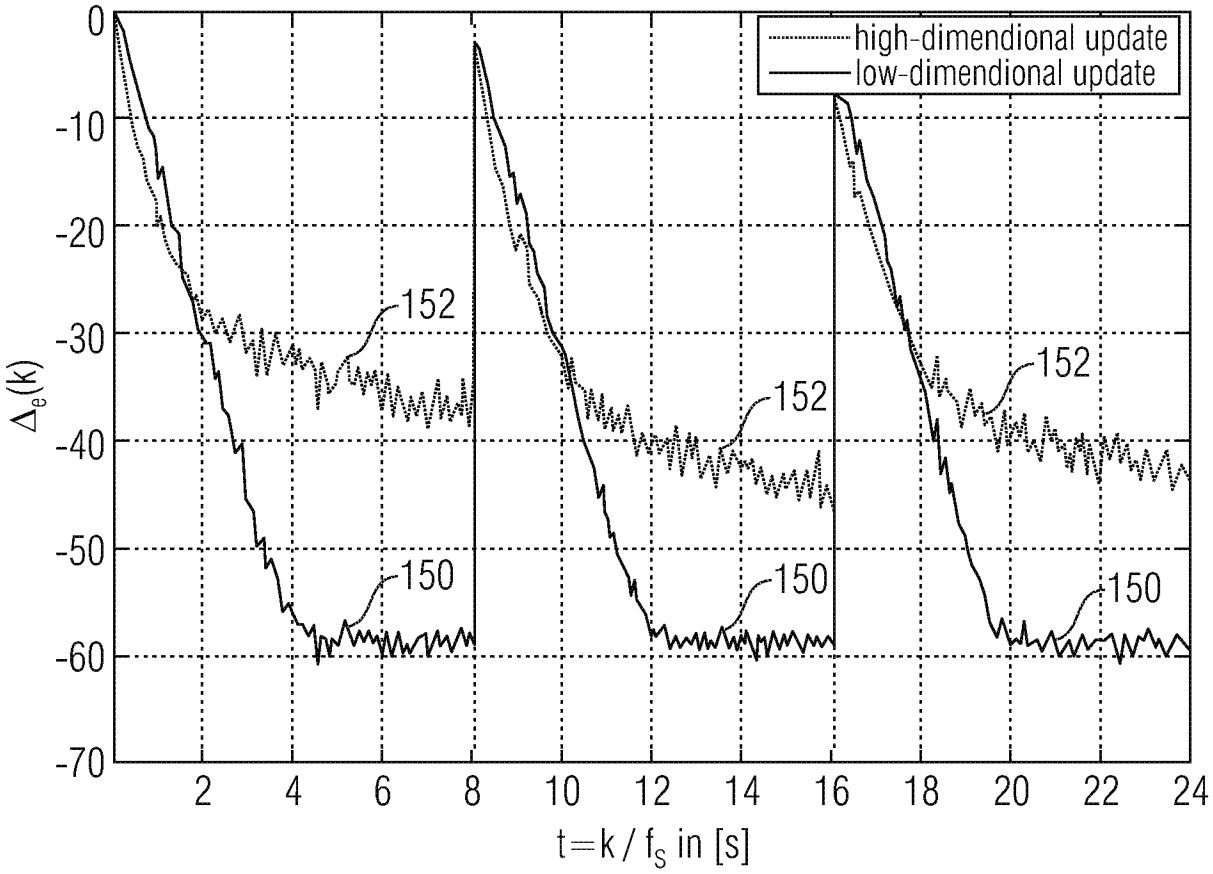
FIG. 9B shows in a diagram a normalized residual error signal at the microphone of the rendering system of FIG. 9A from a direct estimation of the low-dimensional, source specific system and from the estimation of the high-dimensional LEMS.

FIG. 9B shows a diagram of a normalized residual error signal at the microphone 104 resulting during the first experiment from a direct estimation of the low-dimensional, source-specific system (curve 150) and from the estimation of the high-dimensional LEMS (curve 512).

Obviously, the normalized residual error depicted in FIG. 9B quickly drops more uniform by SSSysId, where a unique solution of the adaptive filters can be found, up to the noise floor. Both SSSysId and a direct LEMS update reveal a very similar performance breakdown in case of scene changes. This shows the applicability of SSSysId for AEC.

Figure 10A:
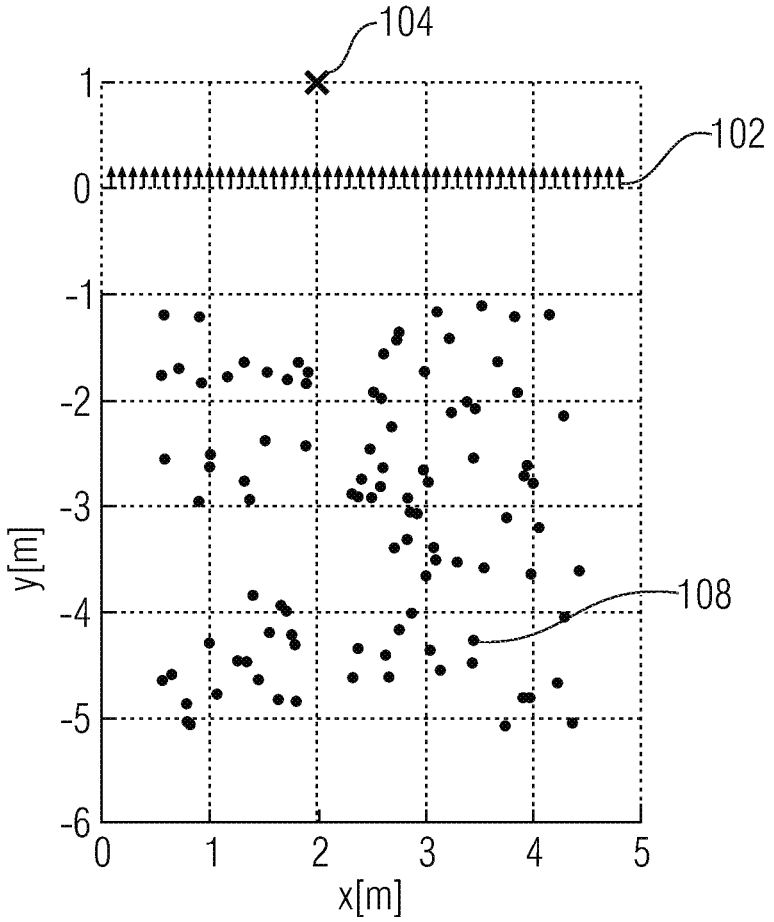
FIG. 10A shows a schematic block diagram of a spatial arrangement of a rendering system with 48 loudspeakers and one microphone, according to an embodiment.

According to a second experiment, a study of the long-term stability of the proposed adaptation scheme is performed. To this end, 100 different virtual source positions are drawn with coordinates $\vec{x}_S=[x,y,0]^T$, $x\in[0.5,4.5]$, $y\in[-5.1,-1.1]$ and each source is exclusively active in its own interval of length 1 s. The resulting scene is depicted in FIG. 10A and corresponds to 99 source configuration changes. In detail, FIG. 10A shows a setup of $N_L$=48 loudspeakers 102 (arrows), $N_M$=1 microphone 104 (cross), and 100 randomly chosen virtual source positions 108.

Figure 10B:
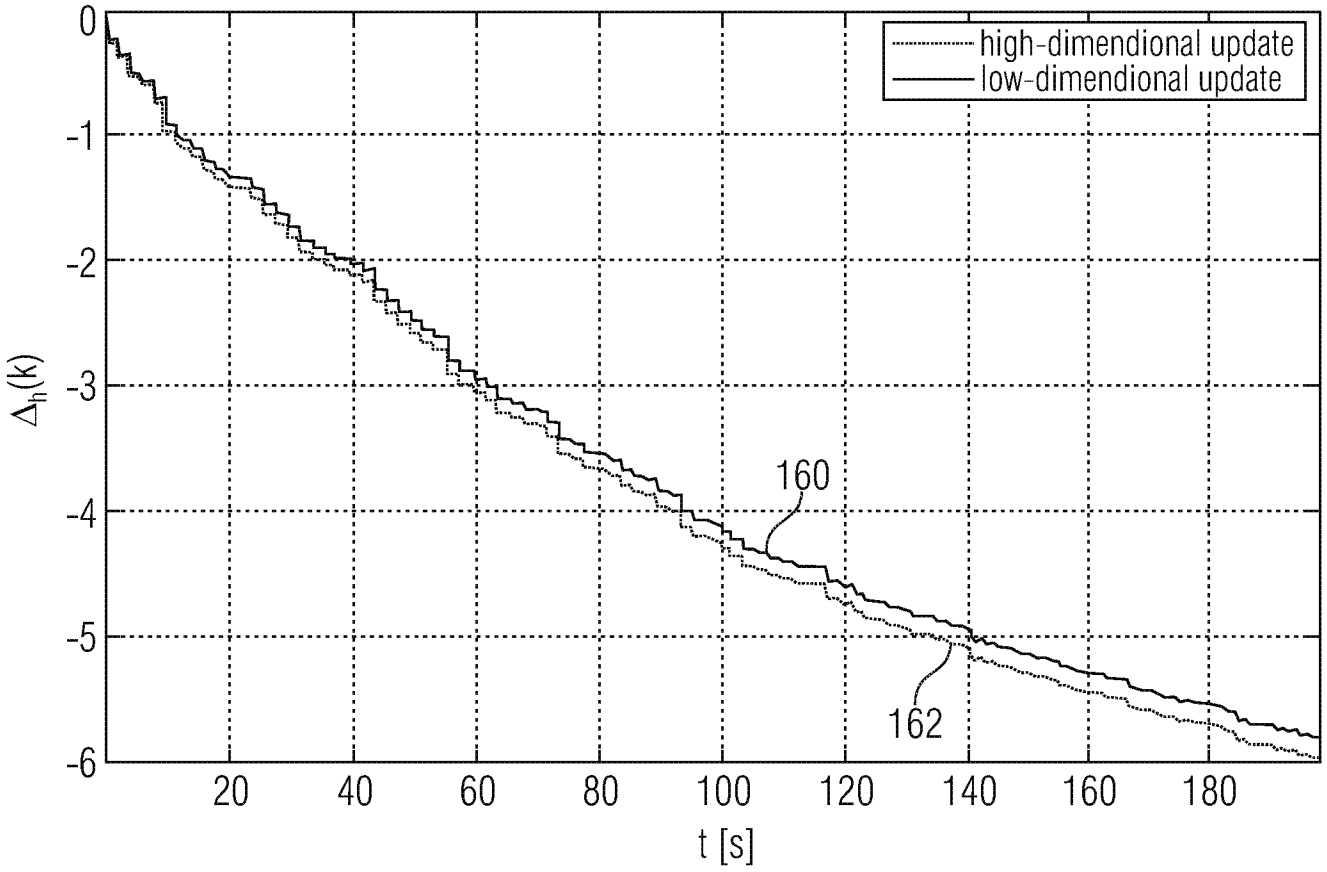
FIG. 10B shows in a diagram a system error norm achievable by transforming the low-dimensional source-specific system into an LEMS estimate in comparison to a direct LEMS update.

The adaptation of source-specific systems and the direct adaptation of the LEMS will be compared in terms of the normalized system error norms. These are depicted in FIG. 10B for each of the 100 intervals (determined at the respective intervals' ends). Thereby, FIG. 10B shows a system error norm achievable during the second experiment by transforming the low-dimensional source-specific system into an LEMS estimate (curve 160) in comparison to a direct LEMS update (curve 162).

Obviously, the less complex source-specific updates (curve 160) lead to a completely stable adaptation and similar performance as updating the LEMS directly (curve 162), also in case of repeatedly changing virtual source configurations and for excitation with just a single virtual source. Thereby, the computational complexity is reduced by an order of magnitude. However, a slightly increased normalized system error norm is the result of the repeated transforms with regularized rendering inverse filters and the truncation of the convolution results to the modeled filter lengths.

Embodiments provide a method for identifying a MIMO system employing side information (statistically independent virtual source signals, rendering filters) from an object-based rendering system (e.g., WFS or hands-free communication using a multi-loudspeaker front-end). This method does not make any assumptions about loudspeaker and microphone positions and allows system identification optimized to have minimum peak load or average load. As opposed to state-of-the-art methods, this approach has predictably low computational complexity, independent of the spectral or spatial characteristics of the $N_S$ virtual sources and the positions of the transducers ($N_L$ loudspeakers and $N_M$ microphones). For long intervals of constant virtual source configuration, a reduction of the complexity by a factor of about $N_L/N_S$ is possible. A prototype has been simulated in order to verify the concept exemplarily for the identification of an LEMS for WFS with a linear sound bar.

Figure 11:
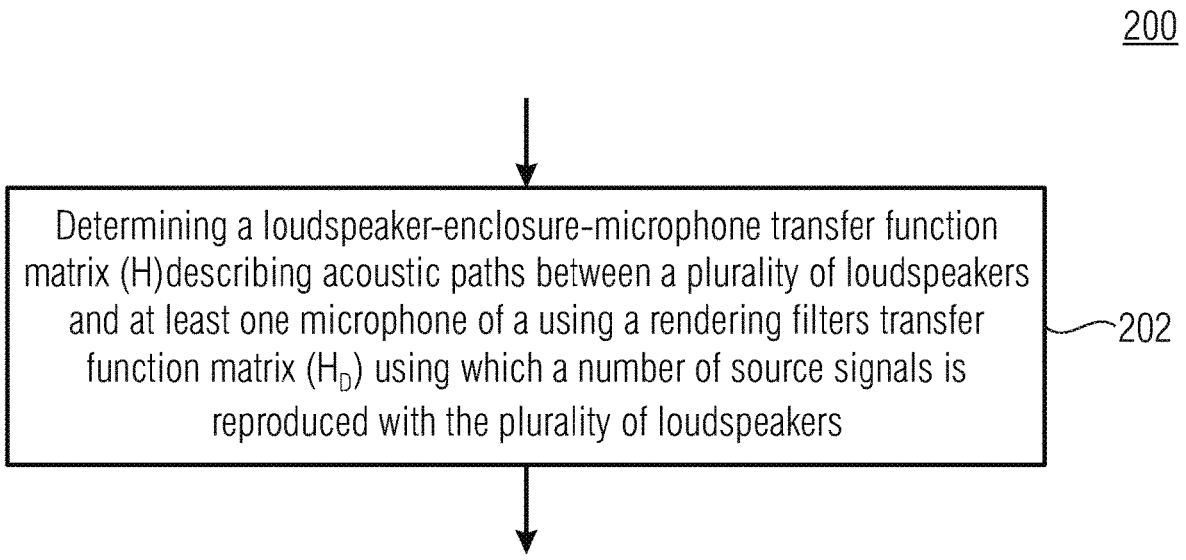
FIG. 11 shows a flowchart of a method for operating a rendering system, according to an embodiment of the present invention.

FIG. 11 shows a flowchart of a method 200 for operating a rendering system, according to an embodiment of the present invention. The method 200 comprises a step 202 of determining a loudspeaker-enclosure-microphone transfer function matrix describing acoustic paths between a plurality of loudspeakers and at least one microphone using a rendering filters transfer function matrix using which a number of source signals is reproduced with the plurality of loudspeakers.

Figure 12:
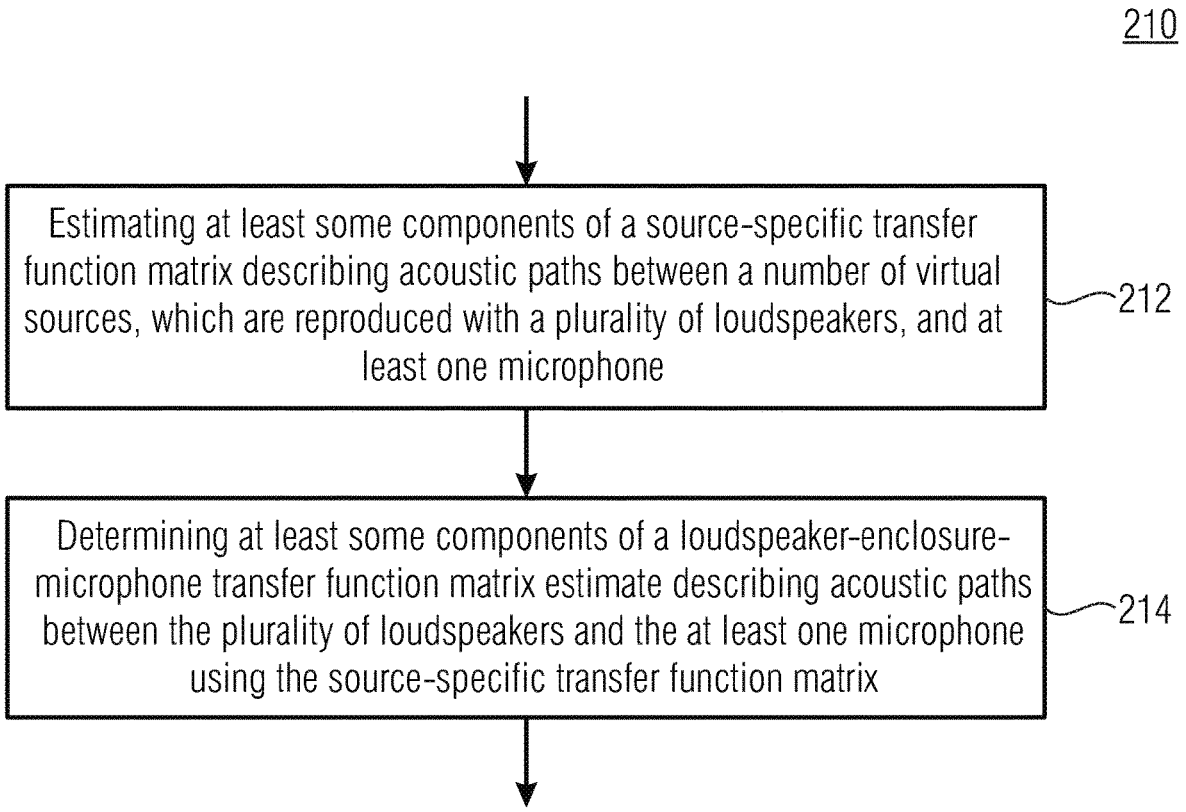
FIG. 12 shows a flowchart of a method for operating a rendering system, according to an embodiment of the present invention.

FIG. 12 shows a flowchart of a method 210 for operating a rendering system, according to an embodiment of the present invention. The method 210 comprising a step 212 of estimating at least some components of a source-specific transfer function matrix describing acoustic paths between a number of virtual sources, which are reproduced with a plurality of loudspeakers, and at least one microphone, and a step 214 of determining at least some components of a loudspeaker-enclosure-microphone transfer function matrix estimate describing acoustic paths between the plurality of loudspeakers and the at least one microphone using the source-specific transfer function matrix.

Many applications entail the identification of a Loudspeaker-Enclosure-Microphone System (LEMS) with multiple inputs (loudspeakers) and multiple outputs (microphones). The involved computational complexity typically grows at least proportionally along the number of acoustic paths, which is the product of the number of loudspeakers and the number of microphones. Furthermore, typical loudspeaker signals are highly correlated and preclude an exact identification of the LEMS ('non-uniqueness problem'). A state-of-the art method for multichannel system identification known as Wave-Domain Adaptive Filtering (WDAF) employs the inherent nature of acoustic sound fields for complexity reduction and alleviates the non-uniqueness problem for special transducer arrangements. On the other hand, embodiments do not make any assumption about the actual transducer placement, but employs side-information available in an object-based rendering system (e.g., Wave Field Synthesis (WFS)) for which the number of virtual sources is lower than the number of loudspeakers to reduce the computational complexity. In embodiments, (only) a source-specific system from each virtual source to each microphone can be identified adaptively and uniquely. This estimate for a source-specific system then can be transformed into an LEMS estimate. This idea can be further extended to the identification of an LEMS for the case of different virtual source configurations in different time intervals. For this general case, the idea of a peak-load-optimized and an average-load-optimized structure are presented, where the peak-load-optimized is well suited for less powerful systems and the average-load-optimized structure for powerful but portable systems which have to minimize the average consumption of electrical power.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

The apparatus described herein may be implemented using a hardware apparatus, or using a computer, or using a combination of a hardware apparatus and a computer.

The methods described herein may be performed using a hardware apparatus, or using a computer, or using a combination of a hardware apparatus and a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A rendering system, comprising:

plurality of loudspeakers;

at least one microphone;

a signal processing unit;

wherein using a rendering filters transfer function matrix a number of virtual sources is reproduced with the plurality of loudspeakers; and wherein the signal processing unit is configured to determine at least some components of a loudspeaker-enclosure-microphone transfer function matrix estimate describing acoustic paths between the plurality of loudspeakers and the at least one microphone using said rendering filters transfer function matrix;

wherein the signal processing unit is configured to estimate at least some components of a source-specific transfer function matrix describing acoustic paths between the number of virtual sources and the at least one microphone; and wherein the processing unit is configured to determine the loudspeaker-enclosure-microphone transfer function matrix estimate using the estimated source-specific signal transfer function matrix; wherein the signal processing unit is configured to determine at least some components of the loudspeaker-enclosure-microphone transfer function matrix estimate based on the equation $$\hat{H}=\hat{H}_S H_D^+,$$

wherein $\hat{H}$ represents the loudspeaker-enclosure-microphone transfer function matrix estimate, wherein $\hat{H}_S$ represents the estimated source-specific transfer function matrix, wherein $H_D$ represents the rendering filters transfer function matrix, and wherein $H_D^+$ represents an approximate inverse of the rendering filters' transfer function matrix $H_D$.

2. The rendering system according to claim 1, wherein the signal processing unit is configured to adaptively estimate the source-specific transfer function matrix by minimizing a cost function derived from a difference between a recorded signal of the at least one microphone and an estimated signal of the at least one microphone obtained using the estimated source-specific transfer function matrix.

3. The rendering system according to claim 1, wherein the signal processing unit is configured to determine the components of the loudspeaker-enclosure-microphone transfer function matrix estimate which are sensitive to a column space of the rendering filters transfer function matrix.

4. The rendering system according to claim 1, wherein in response to a change of at least one out of a number of virtual sources and a position of at least one of the virtual sources, the signal processing unit is configured to update at least some components of the loudspeaker-enclosure-microphone transfer function matrix estimate using a rendering filters transfer function matrix corresponding to the changed virtual sources.

5. The rendering system according to claim 1, wherein the signal processing unit is configured to update at least some components of the loudspeaker-enclosure-microphone transfer function matrix estimate based on the equation $$\hat{H}(\kappa|\kappa)=\hat{H}^{\perp}(\kappa|\kappa-1)+\hat{H}_S(\kappa|\kappa)H_D^+(\kappa)$$

wherein $\kappa-1$ denotes a previous time interval, wherein $\kappa$ denotes a current time interval, wherein between the previous time interval and the current time interval at least one out of a number of virtual sources and a position of at least one of the virtual sources is changed, wherein $\hat{H}(\kappa|\kappa)$ represents a loudspeaker-enclosure-microphone transfer function matrix estimate, $\hat{H}^{\perp}(\kappa|\kappa-1)$ represents components of the loudspeaker-enclosure-microphone transfer function matrix estimate which are not sensitive to the column space of the rendering filters transfer function matrix, $\hat{H}_S(\kappa|\kappa)$ represents an estimated source-specific transfer function matrix, and wherein $H_D^+(\kappa)$ represents an inverse rendering filters transfer function matrix.

6. The rendering system according to claim 4, wherein the signal processing unit is configured to update at least some components of the loudspeaker-enclosure-microphone transfer function matrix estimate based on the equation $$\hat{H}(\kappa|\kappa)=\hat{H}(\kappa|\kappa-1)+(\hat{H}_S(\kappa|\kappa)-\hat{H}_S(\kappa|\kappa-1))H_D^+(\kappa)$$

in order to reduce an average load of the signal processing unit;

wherein $\kappa-1$ denotes a previous time interval, wherein $\kappa$ denotes a current time interval, wherein between the current time interval and the previous time interval at least one out of a number of virtual sources and a position of at least one of the virtual sources is changed, wherein $\hat{H}(\kappa|\kappa)$ represents a loudspeaker-enclosure-microphone transfer function matrix estimate, wherein $\hat{H}(\kappa|\kappa-1)$ represents a loudspeaker-enclosure-microphone transfer function matrix estimate, $\hat{H}_S(\kappa|\kappa)$ represents an estimated source-specific transfer function matrix, wherein $\hat{H}(\kappa|\kappa-1)$ represents a loudspeaker-enclosure-microphone transfer function matrix estimate, and wherein $H_D^+(\kappa)$ represents an inverse rendering filters transfer function matrix.

7. The rendering system according to claim 4, wherein the signal processing unit is configured to update at least some components of the loudspeaker-enclosure-microphone transfer function matrix estimate based on the distributedly evaluated equation $$\hat{H}(\kappa|\kappa)=\hat{H}(\kappa-1|\kappa-2)+\hat{H}_S^{\Delta}(\kappa-1)H_D^+(\kappa-1)$$

as part of an initialization of a following interval's estimated source-specific transfer function matrix by $$\hat{H}_S(\kappa+1|\kappa)=(\hat{H}(\kappa-1|\kappa-2)+\hat{H}_S^{\Delta}(\kappa-1)H_D^+(\kappa-1))H_D(\kappa+1)+\hat{H}_S^{\Delta}(\kappa)H_T^{(\kappa,\kappa+1)}$$

in order to reduce a peak load of the signal processing unit;

wherein $\kappa-2$ denotes a second previous time interval, wherein $\kappa-1$ denotes a previous time interval, wherein $\kappa$ denotes a current time interval, wherein $\kappa-1$ denotes a following time interval, wherein between the time intervals at least one out of a number of virtual sources and a position of at least one of the virtual sources is changed, wherein $\hat{H}(\kappa|\kappa-1)$ represents a loudspeaker-enclosure-microphone transfer function matrix estimate, $\hat{H}_S(\kappa+1|\kappa)$ represents an estimated source-specific transfer function matrix, wherein $\hat{H}(\kappa-1|\kappa-2)$ represents a loudspeaker-enclosure-microphone transfer function matrix estimate, wherein $\hat{H}_S^{\Delta}(\kappa-1)$ represents an update of an estimated source-specific transfer function matrix, $H_D^+(\kappa-1)$ represents an inverse rendering filters transfer function matrix, $H_D(\kappa+1)$ represents a rendering filters transfer function matrix, $\hat{H}_S^{\Delta}(\kappa)$ represents an update of an estimated source-specific transfer function matrix, and wherein $H_T^{(\kappa,\kappa+1)}$ represents a transition transform matrix which describes an update of an estimated source-specific transfer function matrix of the current time interval to the following time interval, such that only a contribution of $\hat{H}_S^{\Delta}(\kappa)H_T^{(\kappa,\kappa+1)}$ is computed between two time intervals.

8. The rendering system according to claim 1, wherein a number of virtual sources is smaller than a number of loudspeakers.

9. The rendering system according to claim 1, wherein the signals of the virtual sources are statistically independent.

10. A method, comprising:

determining at least some components of a loudspeaker-enclosure-microphone transfer function matrix estimate describing acoustic paths between a plurality of loudspeakers and at least one microphone using a rendering filters transfer function matrix, wherein using said rendering filters transfer function matrix a number of virtual sources is reproduced with the plurality of loudspeakers; and estimating at least some components of a source-specific transfer function matrix describing acoustic paths between the number of virtual sources and the at least one microphone, wherein the loudspeaker-enclosure-microphone transfer function matrix estimate is determined using the estimated source-specific signal transfer function matrix;

wherein at least some components of the loudspeaker-enclosure-microphone transfer function matrix estimate are determined based on the equation $$\hat{H}=\hat{H}_S H_D^{+},$$

wherein $\hat{H}$ represents the loudspeaker-enclosure-microphone transfer function matrix estimate, wherein $\hat{H}_S$ represents the estimated source-specific transfer function matrix, wherein $H_D$ represents the rendering filters transfer function matrix, and wherein $H_D^{+}$, represents an approximate inverse of the rendering filters' transfer function matrix $H_D$.

11. A non-transitory digital storage medium having a computer program stored thereon to perform the method comprising:

determining at least some components of a loudspeaker-enclosure-microphone transfer function matrix estimate describing acoustic paths between a plurality of loudspeakers and at least one microphone using a rendering filters transfer function matrix, wherein using said rendering filters transfer function matrix a number of virtual sources is reproduced with the plurality of loudspeakers; and estimating at least some components of a source-specific transfer function matrix describing acoustic paths between the number of virtual sources and the at least one microphone, wherein the loudspeaker-enclosure-microphone transfer function matrix estimate is determined using the estimated source-specific signal transfer function matrix;

wherein at least some components of the loudspeaker-enclosure-microphone transfer function matrix estimate are determined based on the equation $$\hat{H}=\hat{H}_S H_D^{+}$$

wherein $\hat{H}$ represents the loudspeaker-enclosure-microphone transfer function matrix estimate, wherein $\hat{H}_S$ represents the estimated source-specific transfer function matrix, wherein $H_D$ represents the rendering filters transfer function matrix, and wherein $H_D^{+}$ represents an approximate inverse of the rendering filters' transfer function matrix $H_D$.

12. A rendering system, comprising:

plurality of loudspeakers;

at least one microphone;

a signal processing unit;

wherein using a rendering filters transfer function matrix a number of virtual sources is reproduced with the plurality of loudspeakers; and wherein the signal processing unit is configured to determine at least some components of a loudspeaker-enclosure-microphone transfer function matrix estimate describing acoustic paths between the plurality of loudspeakers and the at least one microphone using said rendering filters transfer function matrix;

wherein the signal processing unit is configured to update at least some components of the loudspeaker-enclosure-microphone transfer function matrix estimate based on the equation $$\hat{H}(\kappa|\kappa)=\hat{H}^{\perp}(\kappa|\kappa-1)+\hat{H}_S(\kappa|\kappa)H_D^{+}(\kappa)$$

wherein $\kappa-1$ denotes a previous time interval, wherein $\kappa$ denotes a current time interval, wherein between the previous time interval and the current time interval at least one out of a number of virtual sources and a position of at least one of the virtual sources is changed, wherein $\hat{H}(\kappa|\kappa)$ represents a loudspeaker-enclosure-microphone transfer function matrix estimate, $\hat{H}^{\perp}(\kappa|\kappa-1)$ represents components of the loudspeaker-enclosure-microphone transfer function matrix estimate which are not sensitive to the column space of the rendering filters transfer function matrix, $\hat{H}_S(\kappa|\kappa)$ represents an estimated source-specific transfer function matrix, and wherein $H_D^{+}(\kappa)$ represents an inverse rendering filters transfer function matrix.

13. A rendering system, comprising:

plurality of loudspeakers;

at least one microphone;

a signal processing unit;

wherein using a rendering filters transfer function matrix a number of virtual sources is reproduced with the plurality of loudspeakers; and wherein the signal processing unit is configured to determine at least some components of a loudspeaker-enclosure-microphone transfer function matrix estimate describing acoustic paths between the plurality of loudspeakers and the at least one microphone using said rendering filters transfer function matrix;

wherein in response to a change of at least one out of a number of virtual sources and a position of at least one of the virtual sources, the signal processing unit is configured to update at least some components of the loudspeaker-enclosure-microphone transfer function matrix estimate using a rendering filters transfer function matrix corresponding to the changed virtual sources;

wherein the signal processing unit is configured to update at least some components of the loudspeaker-enclosure-microphone transfer function matrix estimate based on the equation $$\hat{H}(\kappa|\kappa)=\hat{H}(\kappa|\kappa-1)+(\hat{H}_S(\kappa|\kappa)-\hat{H}_S(\kappa|\kappa-1))H_D^{+}(\kappa)$$

in order to reduce an average load of the signal processing unit;

wherein $\kappa-1$ denotes a previous time interval, wherein $\kappa$ denotes a current time interval, wherein between the current time interval and the previous time interval at least one out of a number of virtual sources and a position of at least one of the virtual sources is changed, wherein $\hat{H}(\kappa|\kappa)$ represents a loudspeaker-enclosure-microphone transfer function matrix estimate, wherein $\hat{H}(\kappa|\kappa-1)$ represents a loudspeaker-enclosure-microphone transfer function matrix estimate, $\hat{H}_S(\kappa|\kappa)$ represents an estimated source-specific transfer function matrix, wherein $\hat{H}(\kappa|\kappa-1)$ represents a loudspeaker-enclosure-microphone transfer function matrix estimate, and wherein $H_D^+(\kappa)$ represents an inverse rendering filters transfer function matrix.

14. A rendering system, comprising:

plurality of loudspeakers;

at least one microphone;

a signal processing unit;

wherein using a rendering filters transfer function matrix a number of virtual sources is reproduced with the plurality of loudspeakers; and wherein the signal processing unit is configured to determine at least some components of a loudspeaker-enclosure-microphone transfer function matrix estimate describing acoustic paths between the plurality of loudspeakers and the at least one microphone using said rendering filters transfer function matrix;

wherein in response to a change of at least one out of a number of virtual sources and a position of at least one of the virtual sources, the signal processing unit is configured to update at least some components of the loudspeaker-enclosure-microphone transfer function matrix estimate using a rendering filters transfer function matrix corresponding to the changed virtual sources;

wherein the signal processing unit is configured to update at least some components of the loudspeaker-enclosure-microphone transfer function matrix estimate based on the distributedly evaluated equation $$\hat{H}(\kappa|\kappa-1)=\hat{H}(\kappa-1|\kappa-2)+\hat{H}_S^{\Delta}(\kappa-1)H_D^+(\kappa-1)$$

as part of an initialization of a following interval's estimated source-specific transfer function matrix by $$\hat{H}_S(\kappa+1|\kappa)=(\hat{H}(\kappa-1|\kappa-2)+\hat{H}_S^{\Delta}(\kappa-1)H_D^+(\kappa-1))H_D(\kappa+1)+\hat{H}_S^{\Delta}(\kappa)H_T^{(\kappa,\kappa+1)}$$

in order to reduce a peak load of the signal processing unit;

wherein $\kappa-2$ denotes a second previous time interval, wherein $\kappa-1$ denotes a previous time interval, wherein $\kappa$ denotes a current time interval, wherein $\kappa+1$ denotes a following time interval, wherein between the time intervals at least one out of a number of virtual sources and a position of at least one of the virtual sources is changed, wherein $\hat{H}(\kappa|\kappa-1)$ represents a loudspeaker-enclosure-microphone transfer function matrix estimate, $\hat{H}_S(\kappa+1|\kappa)$ represents an estimated source-specific transfer function matrix, wherein $\hat{H}(\kappa-1|\kappa-2)$ represents a loudspeaker-enclosure-microphone transfer function matrix estimate, wherein $\hat{H}_S^{\Delta}(\kappa-1)$ represents an update of an estimated source-specific transfer function matrix, $H_D^+(\kappa-1)$ represents an inverse rendering filters transfer function matrix, $H_D(\kappa+1)$ represents a rendering filters transfer function matrix, $\hat{H}_S^{\Delta}(\kappa)$ represents an update of an estimated source-specific transfer function matrix, and wherein $H_T^{(\kappa,\kappa+1)}$ represents a transition transform matrix which describes an update of an estimated source-specific transfer function matrix of the current time interval to the following time interval, such that only a contribution of $\hat{H}_S^{\Delta}(\kappa)H_T^{(\kappa,\kappa+1)}$ is computed between two time intervals.

* * * * *